US009631385B1

(12) United States Patent
Phillips

(10) Patent No.: US 9,631,385 B1
(45) Date of Patent: Apr. 25, 2017

(54) CONVERTIBLE FLOOR PANEL ASSEMBLY, COMPOSITE FLOOR STRUCTURE, AND METHOD FOR FILLING AN ORCHESTRA OPENING ADJACENT A THEATER STAGE

(71) Applicant: Brian O. Phillips, Woodruff, SC (US)

(72) Inventor: Brian O. Phillips, Woodruff, SC (US)

( * ) Notice: Subject to any disclaimer, the term of this patent is extended or adjusted under 35 U.S.C. 154(b) by 0 days.

(21) Appl. No.: 15/061,592

(22) Filed: Mar. 4, 2016

Related U.S. Application Data

(60) Provisional application No. 62/183,952, filed on Jun. 24, 2015.

(51) Int. Cl.

| | |
|---|---|
| ***E04H 3/24*** | (2006.01) |
| ***E04B 5/02*** | (2006.01) |
| ***E04B 5/43*** | (2006.01) |
| ***E04C 2/34*** | (2006.01) |

(52) U.S. Cl.
CPC ..... *E04H 3/24* (2013.01); *E04B 5/02* (2013.01); *E04B 5/43* (2013.01); *E04C 2/34* (2013.01); *E04C 2/50* (2013.01)

(58) Field of Classification Search
CPC ..... E04H 3/24; E04B 5/43; E04B 5/02; E04C 2/50; E04C 2/34
See application file for complete search history.

(56) References Cited

U.S. PATENT DOCUMENTS

| | | | | |
|---|---|---|---|---|
| 2,154,619 | A * | 4/1939 | Hurley | E04C 2/043 52/483.1 |
| 3,020,185 | A * | 2/1962 | Moffitt, Jr. | B29C 70/222 277/640 |
| 3,327,442 | A * | 6/1967 | Hermann | E04F 13/0862 52/309.16 |
| 3,552,104 | A * | 1/1971 | Wood | E04B 9/22 454/284 |
| 4,241,555 | A * | 12/1980 | Dickens | E04C 2/205 52/309.4 |
| 4,284,447 | A * | 8/1981 | Dickens | B29C 33/16 156/299 |
| 8,997,422 | B1 * | 4/2015 | Kim | E04B 1/161 52/422 |
| 2004/0245155 | A1 * | 12/2004 | Strong | B01D 33/0376 209/405 |
| 2015/0292217 | A1 * | 10/2015 | Prati | B32B 3/04 52/483.1 |

* cited by examiner

*Primary Examiner* — Jeanette E Chapman
(74) *Attorney, Agent, or Firm* — Schwartz Law Firm, P.C.

(57) ABSTRACT

A convertible floor panel assembly incorporates a metal wire mesh subfloor and a polymer deck overlying the wire mesh subfloor. A plurality of alignment heads project from an underside of the polymer deck, and are designed to extend through respective mesh openings defined by the wire mesh subfloor. A plurality of panel retainers engage respective alignment heads, and are adapted for removably attaching the wire mesh subfloor and the polymer deck together. The floor panel assembly is thereby convertible between a substantially open-surface sound permeable safety structure and a continuous solid-surface structure for increased floor load capacity.

5 Claims, 43 Drawing Sheets

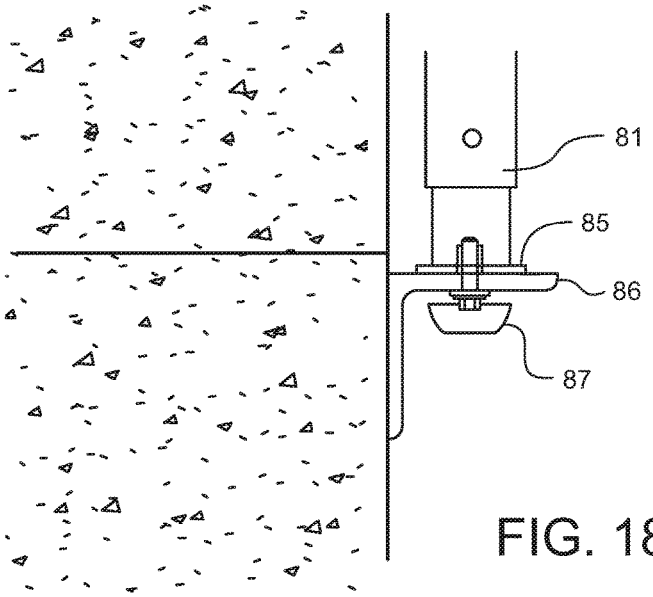
FIG. 18
FIG. 20
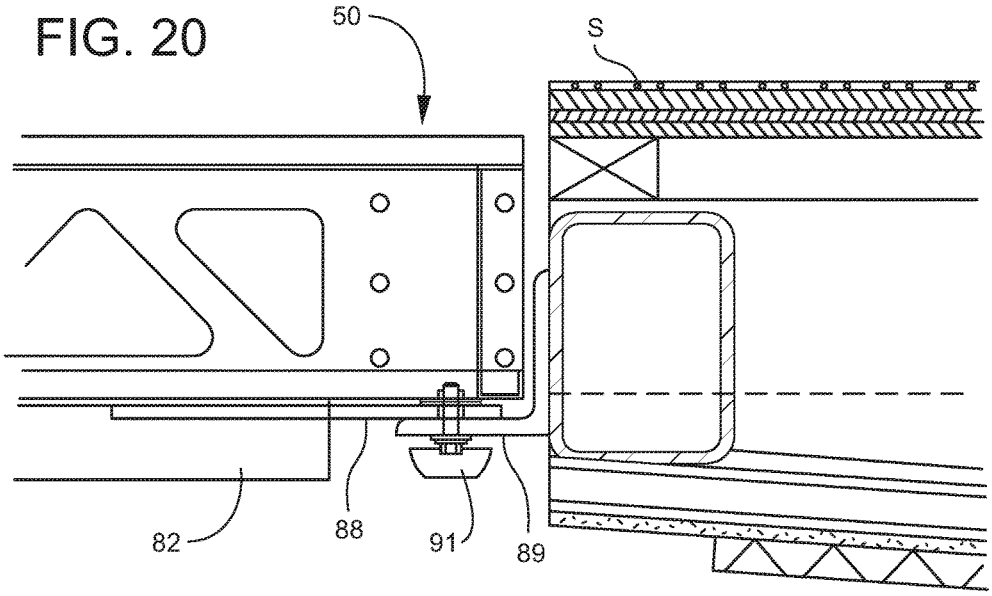

CONVERTIBLE FLOOR PANEL ASSEMBLY, COMPOSITE FLOOR STRUCTURE, AND METHOD FOR FILLING AN ORCHESTRA OPENING ADJACENT A THEATER STAGE

TECHNICAL FIELD AND BACKGROUND OF THE DISCLOSURE

The present disclosure relates broadly and generally to a convertible floor panel assembly, composite floor structure, and method for filling an orchestral opening adjacent a theater stage.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a convertible floor panel assembly incorporating a metal wire mesh subfloor and a polymer deck overlying the wire mesh subfloor. A plurality of alignment heads project from an underside of the polymer deck, and are designed to extend through respective mesh openings defined by the wire mesh subfloor. A plurality of panel retainers engage respective alignment heads, and are adapted for removably attaching the wire mesh subfloor and the polymer deck together. The floor panel assembly is thereby convertible between a substantially open-surface sound permeable safety structure and a continuous solid-surface structure for increased floor load capacity.

According to another exemplary embodiment, the alignment head is integrally formed with the polymer deck, and defines an internally-threaded fastener hole.

According to another exemplary embodiment, the panel retainer comprises an externally-threaded fastener end adapted for inserting into the threaded fastener hole of the alignment head.

According to another exemplary embodiment, the panel retainer further comprises a knurled hand knob opposite its externally-threaded fastener end.

According to another exemplary embodiment, an enlarged-diameter washer has a central opening for receiving the externally-threaded fastener end of the panel retainer, such that the wire mesh subfloor resides between the washer and the polymer deck. The term "enlarged diameter" means sufficiently large to prevent passage of the washer through an adjacent mesh opening formed with the subfloor.

According to another exemplary embodiment, the enlarged-diameter washer defines an annular panel-side recess designed for receiving the alignment head of the polymer panel.

According to another exemplary embodiment, a fabric backing is located on a panel side of the enlarged-diameter washer.

According to another exemplary embodiment, the polymer deck has a thickness ranging from 0.375 to 1.0 inches.

According to another exemplary embodiment, the wire mesh subfloor defines between 36 and 96 uniformly-sized openings per square foot (depending on its particular application).

According to another exemplary embodiment, the wire mesh subfloor and polymer deck have a combined live load capacity of 150 pounds per square foot (psf) or more.

According to another exemplary embodiment, the wire mesh subfloor has a live load capacity of 100 pounds per square foot (psf) or more.

In another exemplary embodiment, the present disclosure comprises a composite floor structure incorporating a truss assembly and a convertible floor panel assembly. The truss assembly comprises an arrangement of open-web beams. The convertible floor panel assembly is carried on the truss assembly, and comprises a metal wire mesh subfloor and polymer deck overlying the wire mesh subfloor. A plurality of alignment heads project from an underside of the polymer deck, and are designed to extend through respective mesh openings defined by the wire mesh subfloor. A plurality of panel retainers engage respective alignment heads, and are adapted for removably attaching the wire mesh subfloor and the polymer deck together. The floor panel assembly is thereby convertible between a substantially open-surface sound permeable safety structure and a continuous solid-surface structure for increased floor load capacity.

As used herein, the term "composite" refers to a floor structure which incorporates an assembly of several and various elements forming an integrated unitary whole.

In yet another exemplary embodiment, the present disclosure comprises a method for filling an orchestral opening adjacent a theater stage. The method includes installing a plurality of convertible floor panel assemblies over the orchestral opening. Each floor panel assembly incorporates a metal wire mesh subfloor and polymer deck overlying the wire mesh subfloor. A plurality of alignment heads project from an underside of the polymer deck, and are designed to extend through respective mesh openings defined by the wire mesh subfloor. A plurality of panel retainers engage respective alignment heads, and are adapted for removably attaching the wire mesh subfloor and the polymer deck together. The floor panel assembly is thereby convertible between a substantially open-surface sound permeable safety structure and a continuous solid-surface structure for increased floor load capacity.

BRIEF DESCRIPTION OF THE DRAWINGS

Exemplary embodiments of the present disclosure will hereinafter be described in conjunction with the following drawing figures, wherein like numerals denote like elements, and wherein:

FIG. 18 is a view illustrating the wall bracket and various components for mounting a vertical element of the supporting L-frame;

FIG. 20 is a view illustrating the wall sill and various components for mounting a horizontal U-channel of the supporting L-frame;

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
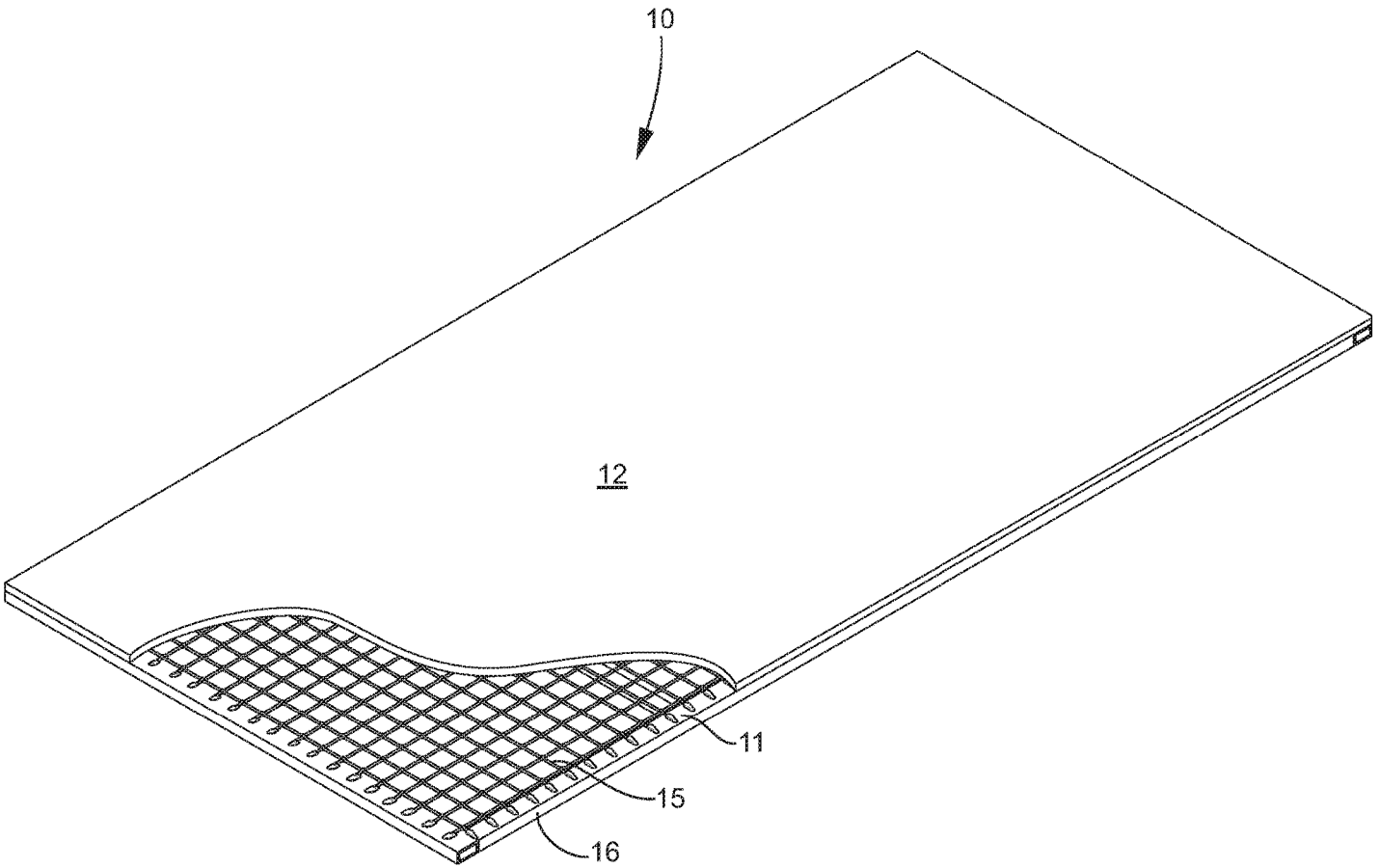
FIG. 1 is a perspective view of a convertible floor panel assembly according to one exemplary embodiment of the present disclosure, and showing a portion of the polymer deck broken away to expose the underlying wire mesh subfloor.
Figure 2:
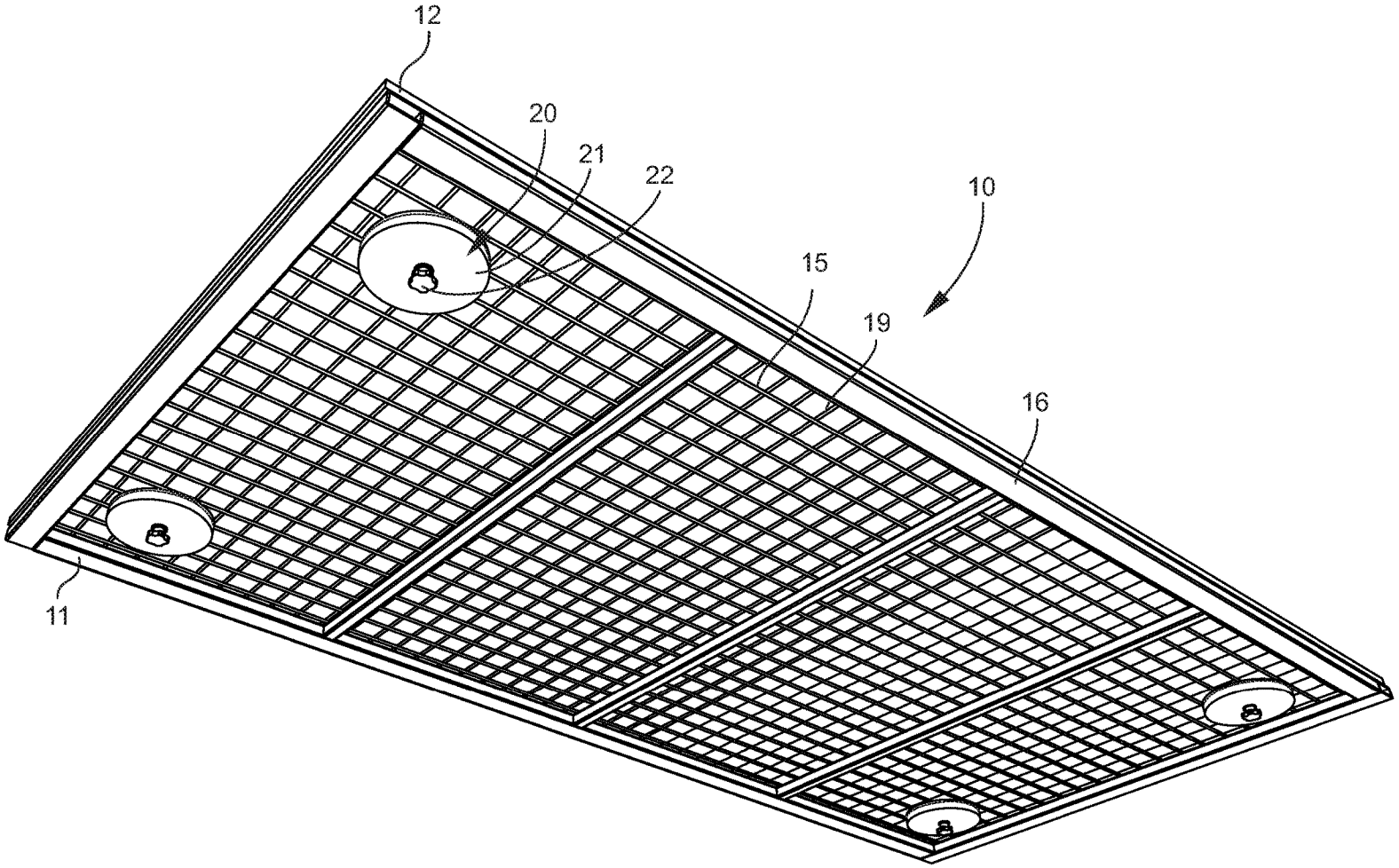
FIG. 2 is a further perspective view showing an underside of the exemplary floor panel assembly.

Referring now specifically to the drawings, a convertible floor panel assembly according to an exemplary embodiment of the present disclosure is illustrated in FIGS. 1 and 2, and shown generally at broad reference numeral 10. In one exemplary application, the present panel assembly 10 is applicable for use in the entertainment industry, and may be installed with like assemblies in situ in theaters to create a temporary floor convertible between a substantially open-surface (both sound and light permeable) safety structure and a continuous solid-surface structure for increased floor load capacity. The exemplary floor may be installed to temporarily fill the orchestral opening adjacent a theater stage, as described below, or may be suspended from a ceiling above the stage to form a walking surface for ready access to overhead lighting instruments and other technical equipment. In other applications, the convertible panel assembly 10 may be incorporated in catwalks for sports arenas, safety flooring in industrial facilities, and other foreseeable structural uses.

Figure 3:
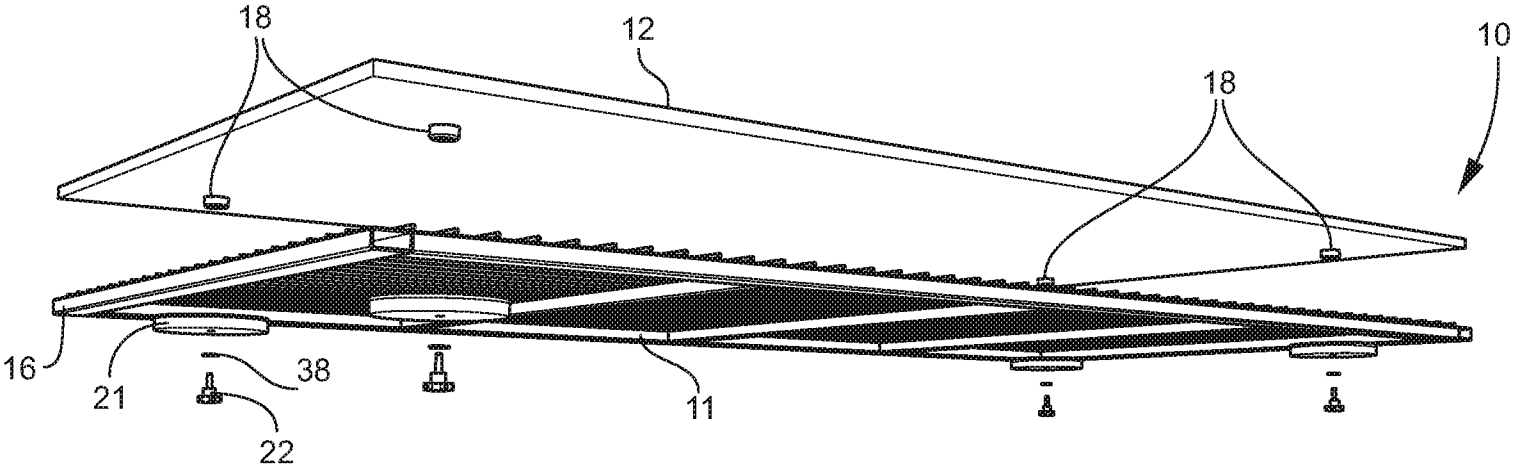
FIG. 3 is an exploded view of the exemplary floor panel assembly.
Figure 4:
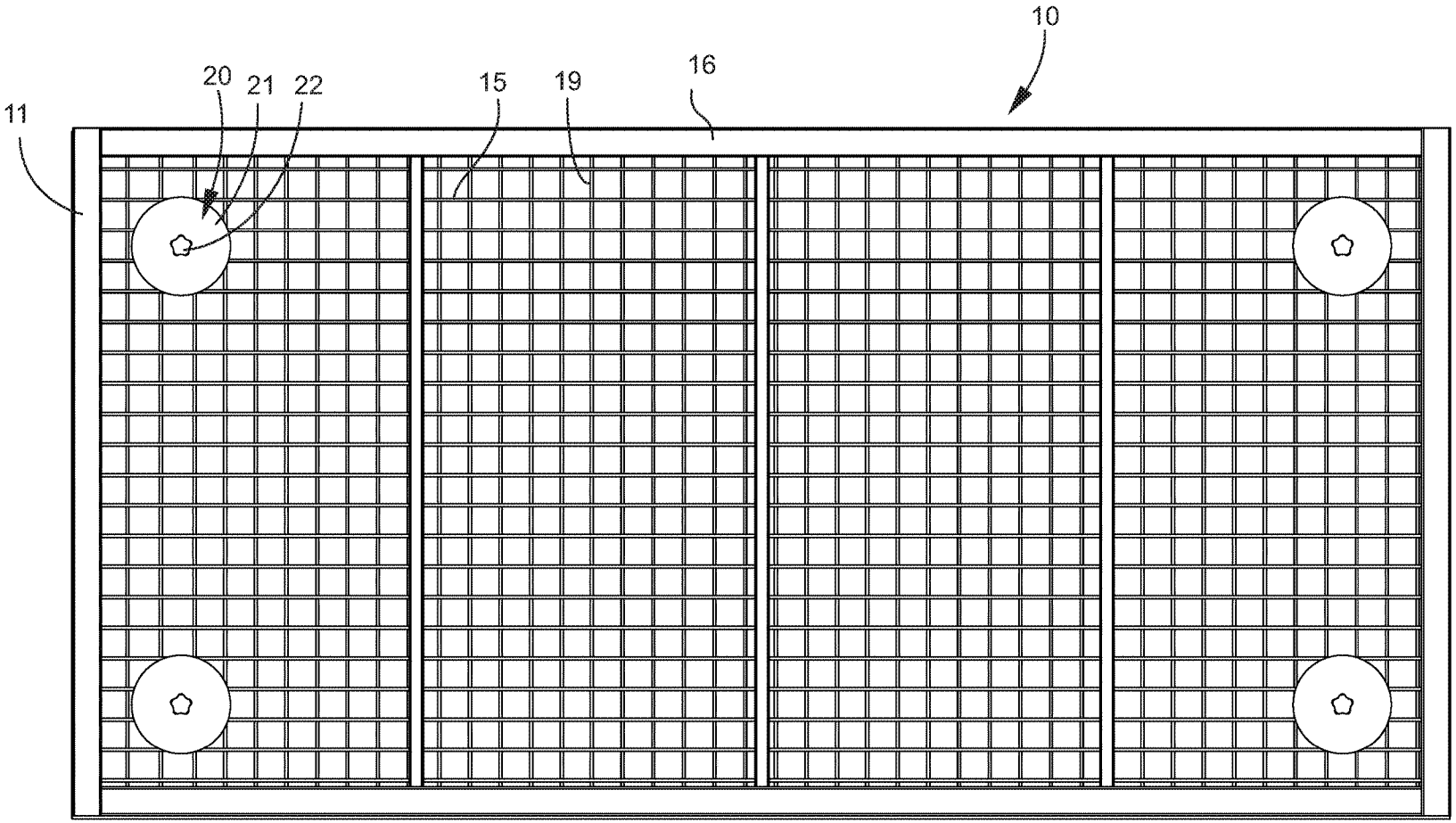
FIG. 4 is a bottom view of the exemplary floor panel assembly.
Figure 5:
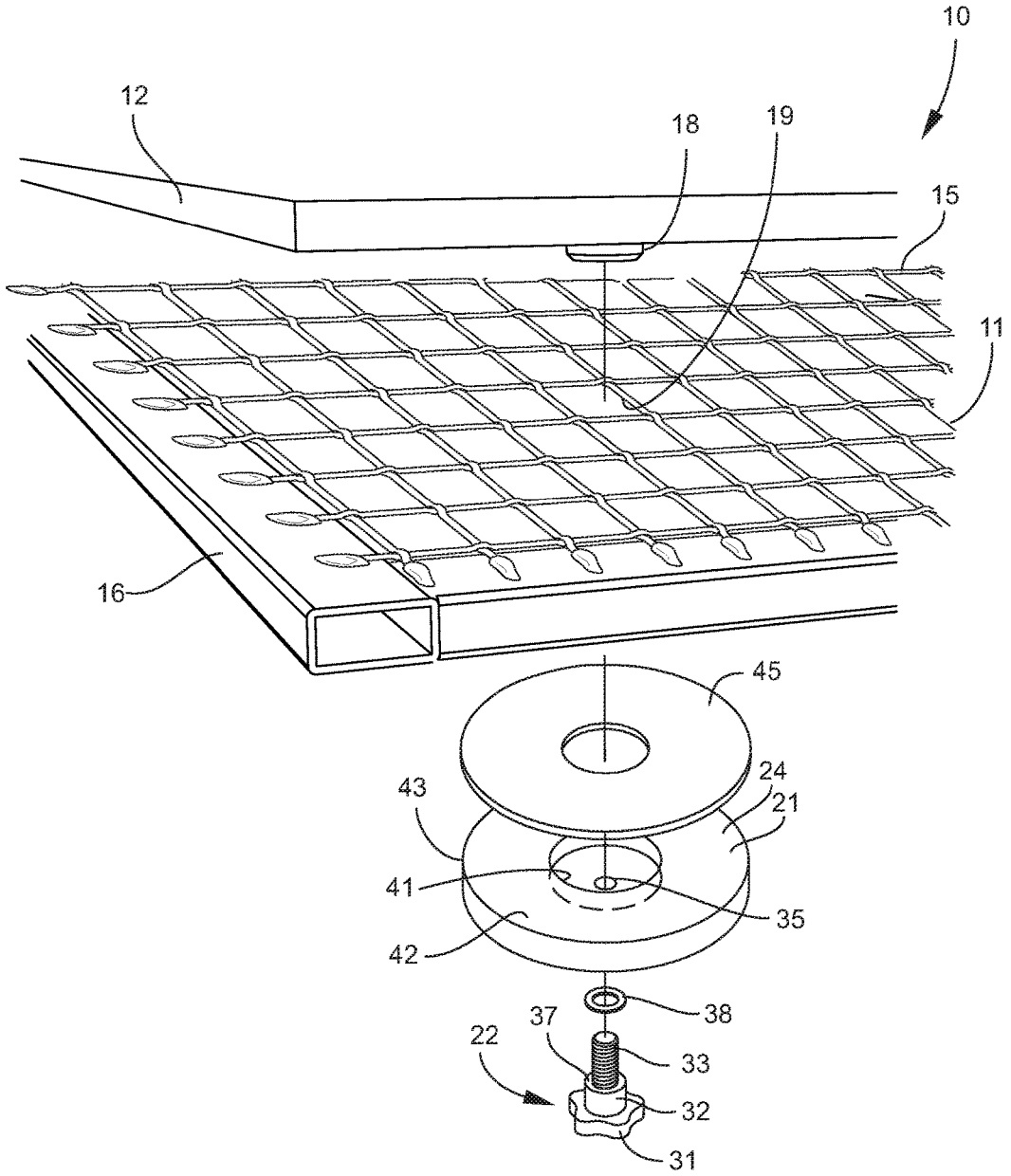
FIG. 5 is an exploded perspective view illustrating various components of the exemplary floor panel assembly.
Figure 6:
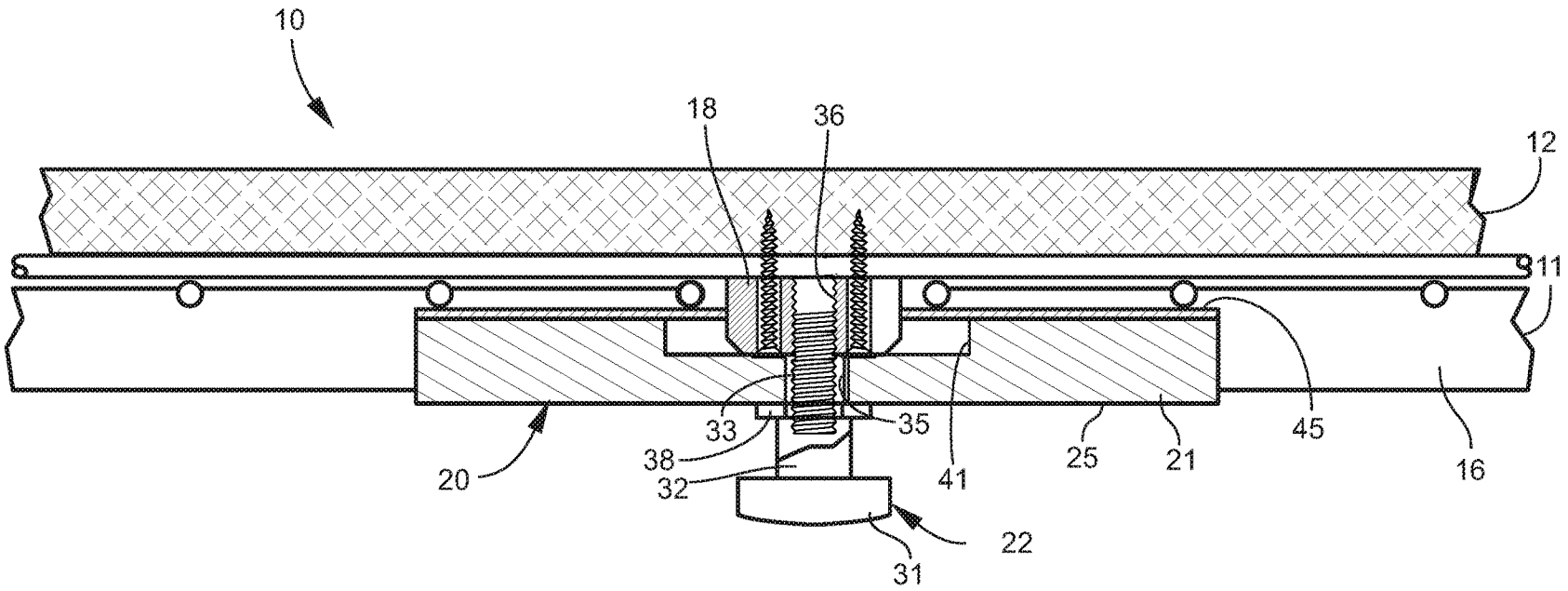
FIG. 6 is a fragmentary cross-sectional view of the floor panel assembly showing the various elements of the panel retainer.
Figure 7:
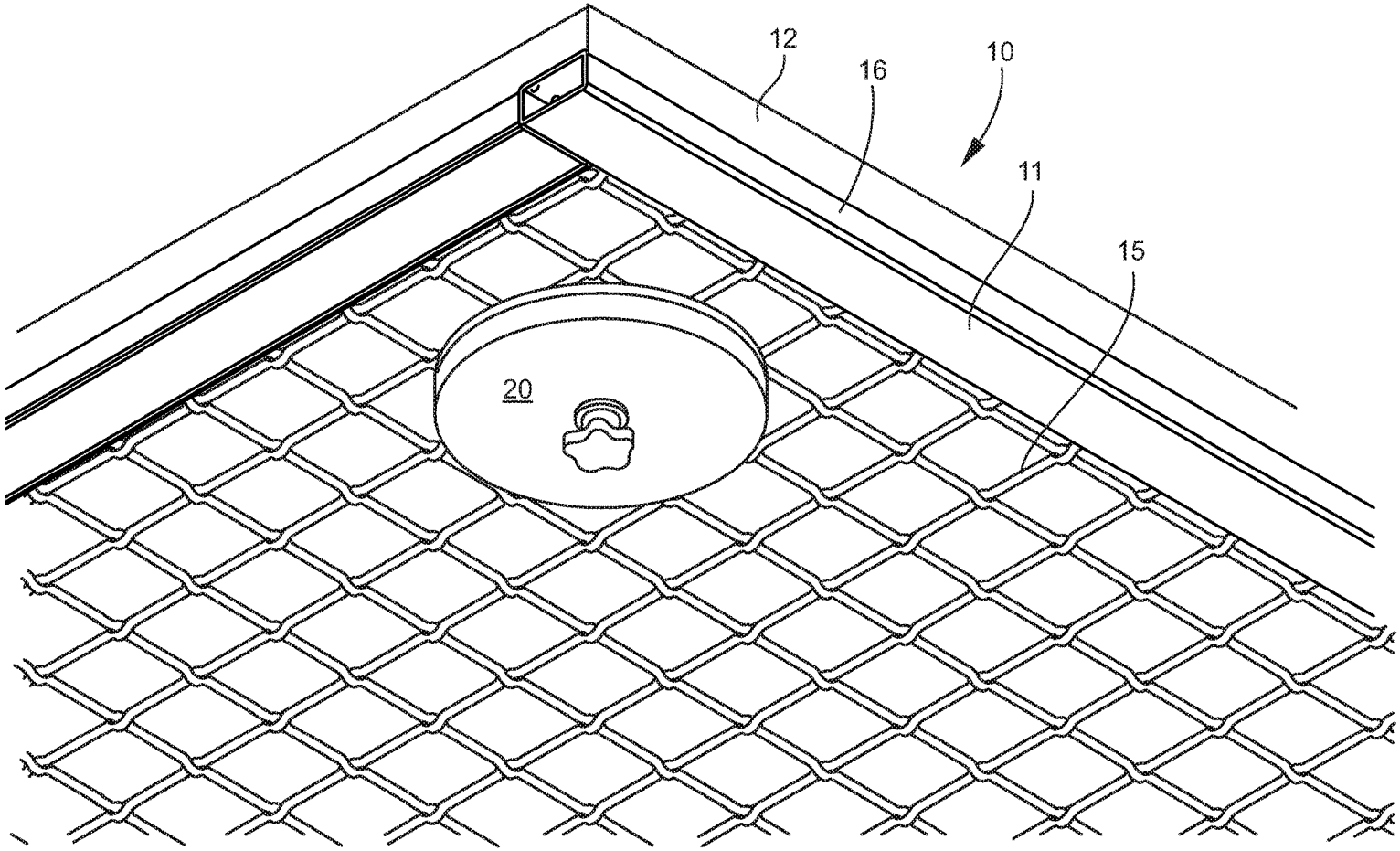
FIG. 7 is a fragmentary perspective view of the floor panel assembly at an underside of one corner.

As best shown in FIGS. 3-7, the exemplary floor panel assembly 10 comprises a wire mesh subfloor 11 and a solid surface polymer deck 12. The exemplary wire mesh subfloor 11 may feature a relatively heavy gage (e.g., 3/16"-5/8") woven wire cloth 15 and lightweight square-tube metal frame 16. The wire cloth 15 may be welded to the metal frame 16, as shown, or secured by clamping, fasteners or other suitable attachment means. The polymer deck 12 overlies the wire mesh subfloor 11 in substantially exact (superimposed) registration, as best shown in FIGS. 3 and 4, and has a number of spaced-apart round alignment heads 18 which project from an underside of the polymer deck 12. The alignment heads 18 extend through respective square openings 19 defined by the wire mesh subfloor 11, as shown in FIGS. 5 and 6, and function to properly position and secure the deck 12 against inadvertent lateral shifting.

Referring to FIGS. 2, 5, 6 and 7, a corresponding number of panel retainers 20 are joined to respective alignment heads 18, and are adapted to removably attach the wire mesh subfloor 11 and the polymer deck 12 together as a single integrated unit. The alignment heads 18 and panel retainers 20 may be strategically spaced-apart proximate respective corners of the floor panel assembly 10. Each panel retainer 20 comprises an annular panel washer 21 and an elongated assembly fastener 22. The exemplary panel washer 21 has opposing inside and outside major surfaces 24, 25, and an enlarged diameter sufficient to prevent passage of the washer 21 through a square opening 19 of the wire mesh subfloor 11. In one example, the openings 19 of the subfloor 11 are uniformly sized and spaced in a crisscrossed grid pattern—each square opening 19 having a dimension of about 2"×2", and each panel washer 21 having a diameter of between about 3-5 inches. The panel washers 21 may be fabricated of a relatively thick and solid polymer composite (blend) such as that used to construct the polymer deck 12.

The exemplary assembly fastener 22 has a knurled hand knob 31, a cylindrical base 32, and an externally-threaded fastener end 33. As best shown in FIGS. 5 and 6, the fastener end 33 inserts through a small central opening 35 formed with the panel washer 21, and mates with a complementary threaded internal opening 36 formed with the alignment head 18. The cylindrical base 32 of the fastener 22 forms an annular shoulder 37 between the hand knob 31 and threaded end 33. The shoulder 37 engages a thin metal washer 38, and cooperates with the metal washer 38 to spread and distribute the load of the fastener 22 against the outside major surface 25 of the panel washer 21. The inside major surface 24 of the panel washer 21 defines a circular centrally-formed recess 41 designed to receive the alignment head 18 of the polymer deck 12, and a flat annular surface area 42 extending from the recess 41 outwardly to an annular edge 43 of the washer 21. The diameter of the circular recess 41 is slightly larger than a diameter of the alignment head 18. In one exemplary embodiment, a ring-shaped felt fabric pad 45 covers substantially the entire annular surface area 42 of the washer 21 outside of the circular recess 41.

When the panel retainer 20 is attached and hand tightened, the threaded fastener end 33 enters the threaded opening 36 of the alignment head 18 while a projecting portion of the alignment head 18 is received within the washer recess 41. The felt fabric padded surface area of the panel washer 21 directly and closely engages the wire mesh subfloor 11, and serves to help dampen sound and vibration generated when walking upon the polymer deck 12. The polymer deck 12 forms a continuous solid-surface structure capable of substantial floor load capacity. In one example, the live load capacity of the floor panel assembly 10 with the polymer deck 12 is about 150 pounds per square foot (psf) or more. In an exemplary embodiment, the solid surface deck 12 comprises a lightweight polymer blend having the high moisture resistance of plastic, the screw retention of hard wood, and substantial rigidity for a variety of uses. Exemplary uses include road cases, portable risers, wall protectors, ramps, pit covers, plywood replacement, and other custom uses. The polymer deck 12 may feature no (or limited) required painting and other maintenance, rigid like wood flooring, warp resistant, solid black throughout, high slip resistance, no water absorption, thermo-moldable, paintable, excellent screw retention, manufactured of recycled content (up to 95% or more), and cut and drill-able with standard woodworking tools.

Figure 8:
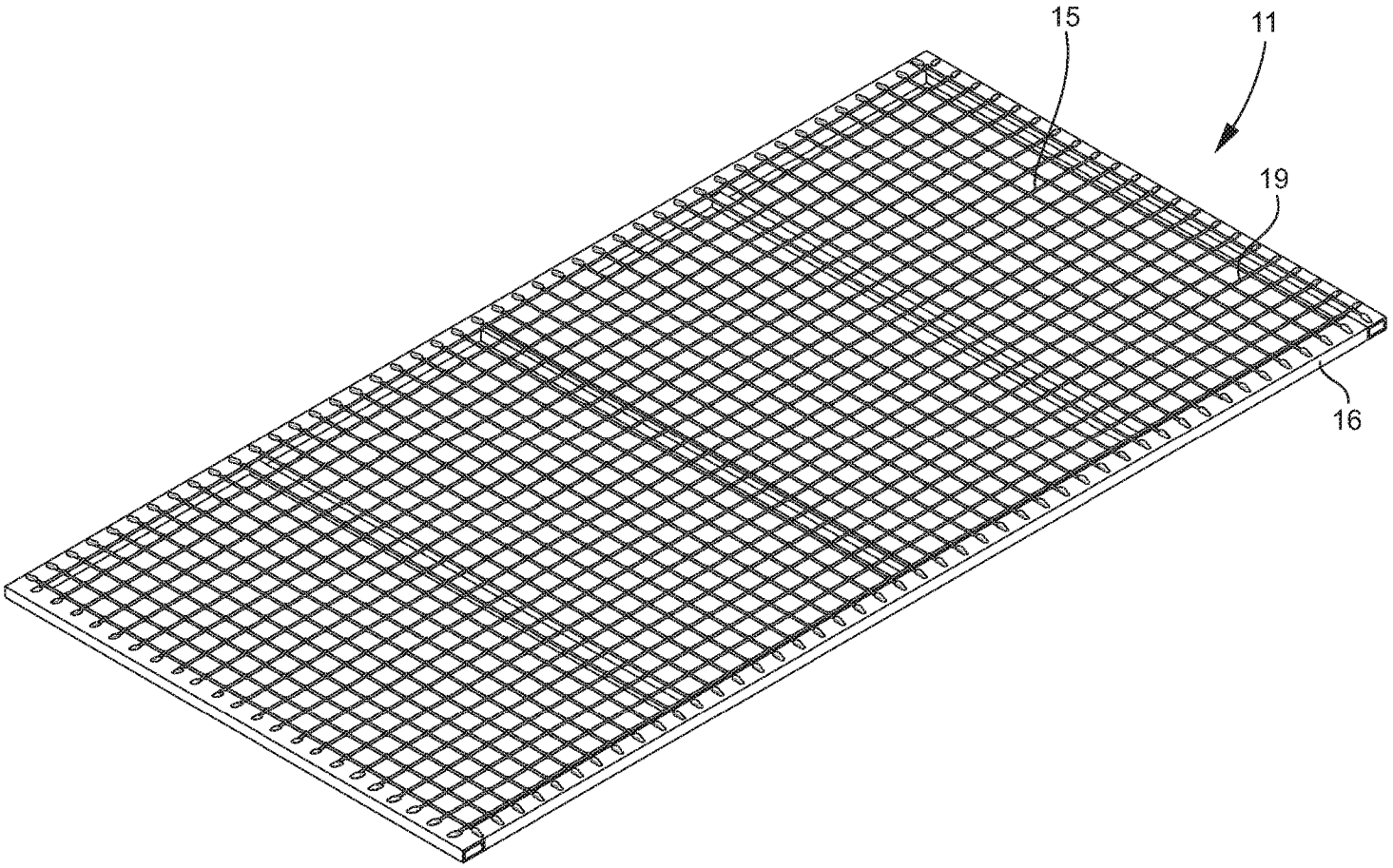
FIG. 8 is a perspective view of the exemplary floor panel assembly converted (by removing the polymer deck) to a substantially open-surface safety structure.
Figure 9:
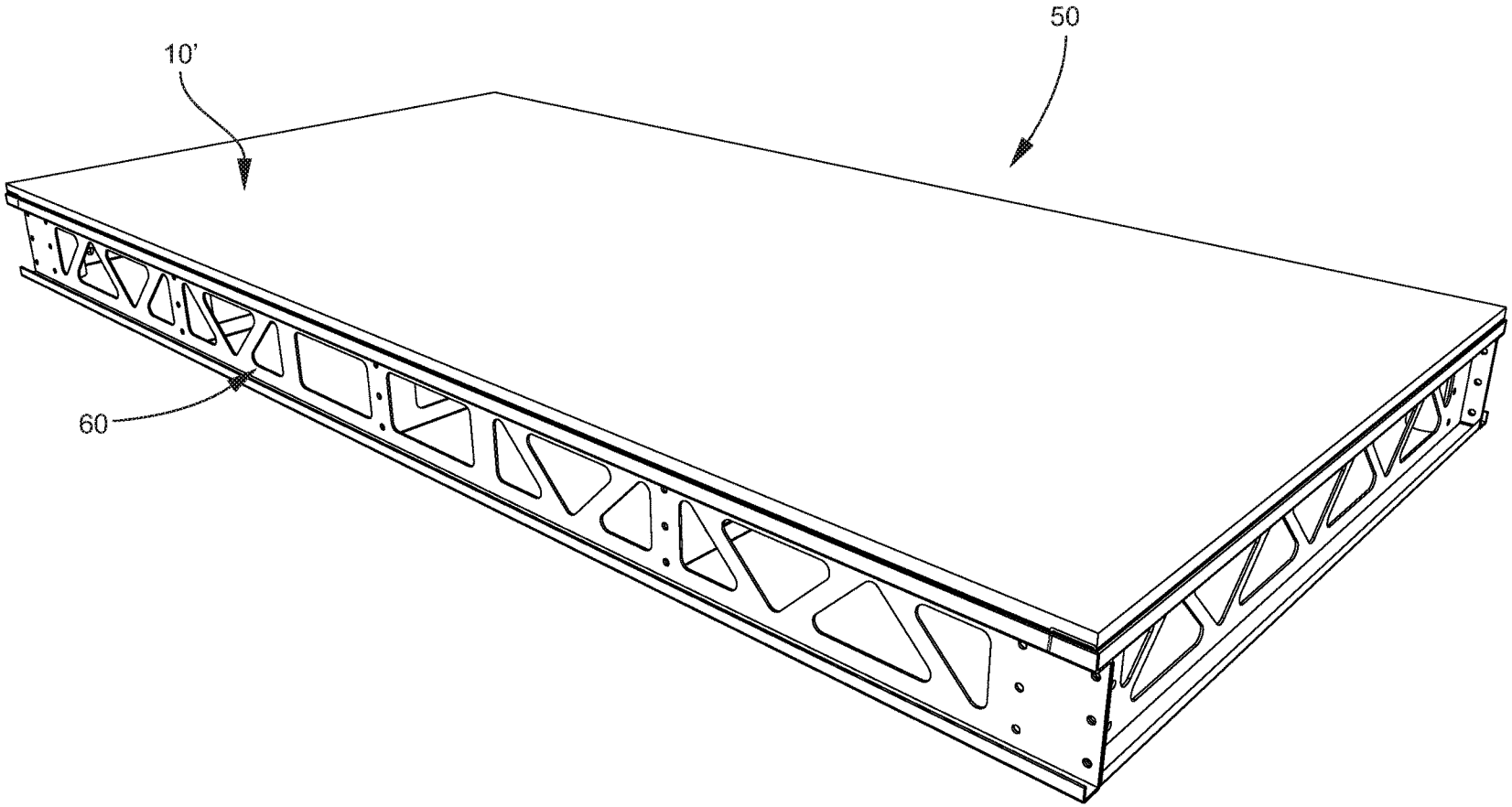
FIG. 9 is a perspective view of a composite floor structure according to an exemplary embodiment of the present disclosure.

The exemplary panel retainer 20 is readily detached by unscrewing the assembly fastener 22 and removing the enlarged panel washer 21. After detaching all panel retainers 20, the polymer deck 12 is conveniently lifted and removed from the wire mesh subfloor 11. With the polymer deck 12 removed, the floor panel assembly 10 is converted to a substantially open-surface sound and light permeable safety structure. See FIG. 8. The wire mesh subfloor 11 may be used alone or in combination with other supporting structure to safely fill the orchestral pit of a theater without impairing the acoustics or sound flow from the orchestra to the audience. The live load capacity of the wire mesh subfloor 11 may be about 100 pounds per square foot (psf) or more. The subfloor 11 may be readily modified for installation of a hatch or access opening, and may be coated to any desired color.

Figure 10:
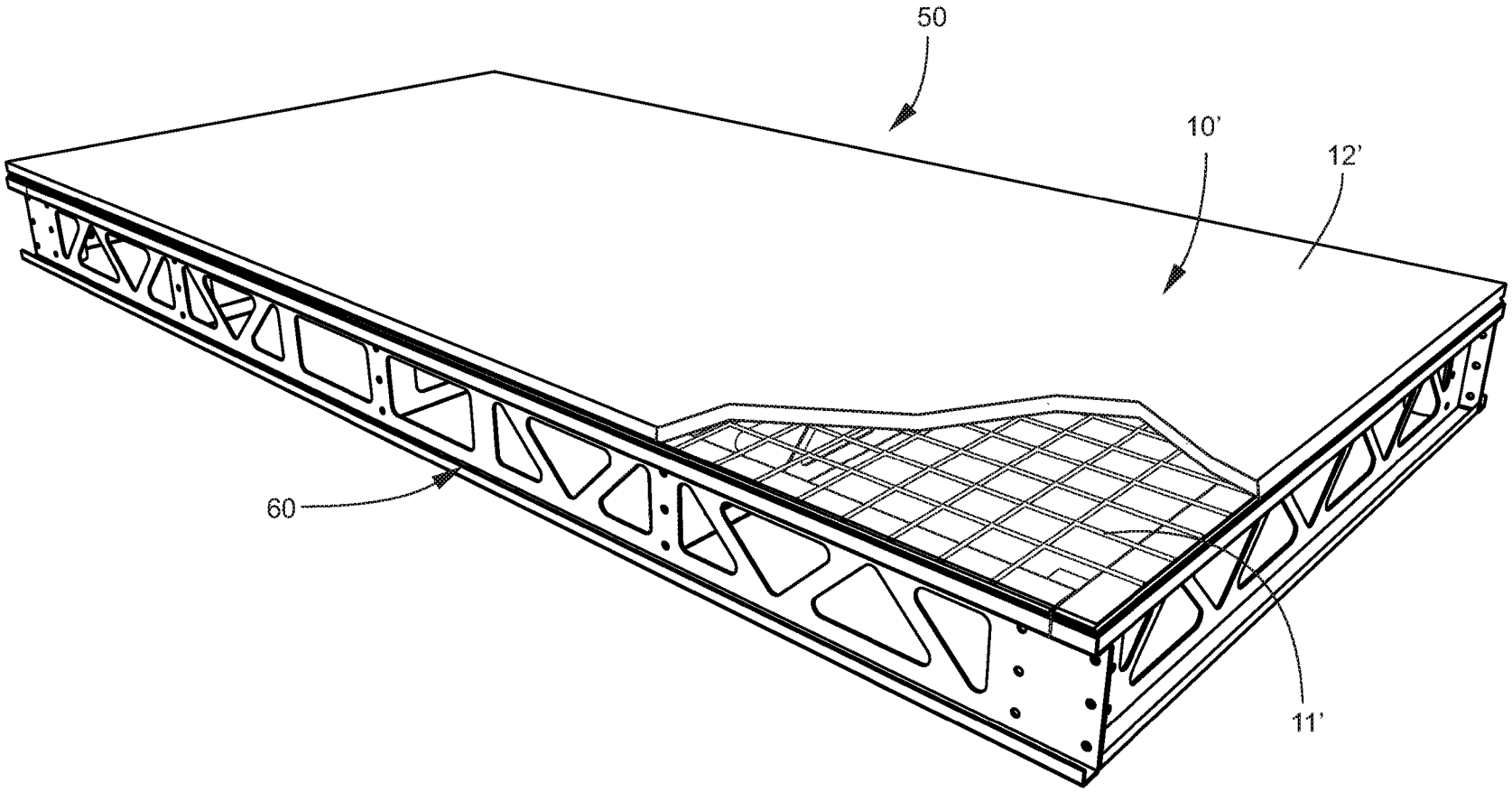
FIG. 10 shows the exemplary composite floor structure with a portion of the top deck broken away to expose the underlying subfloor.
Figure 11:
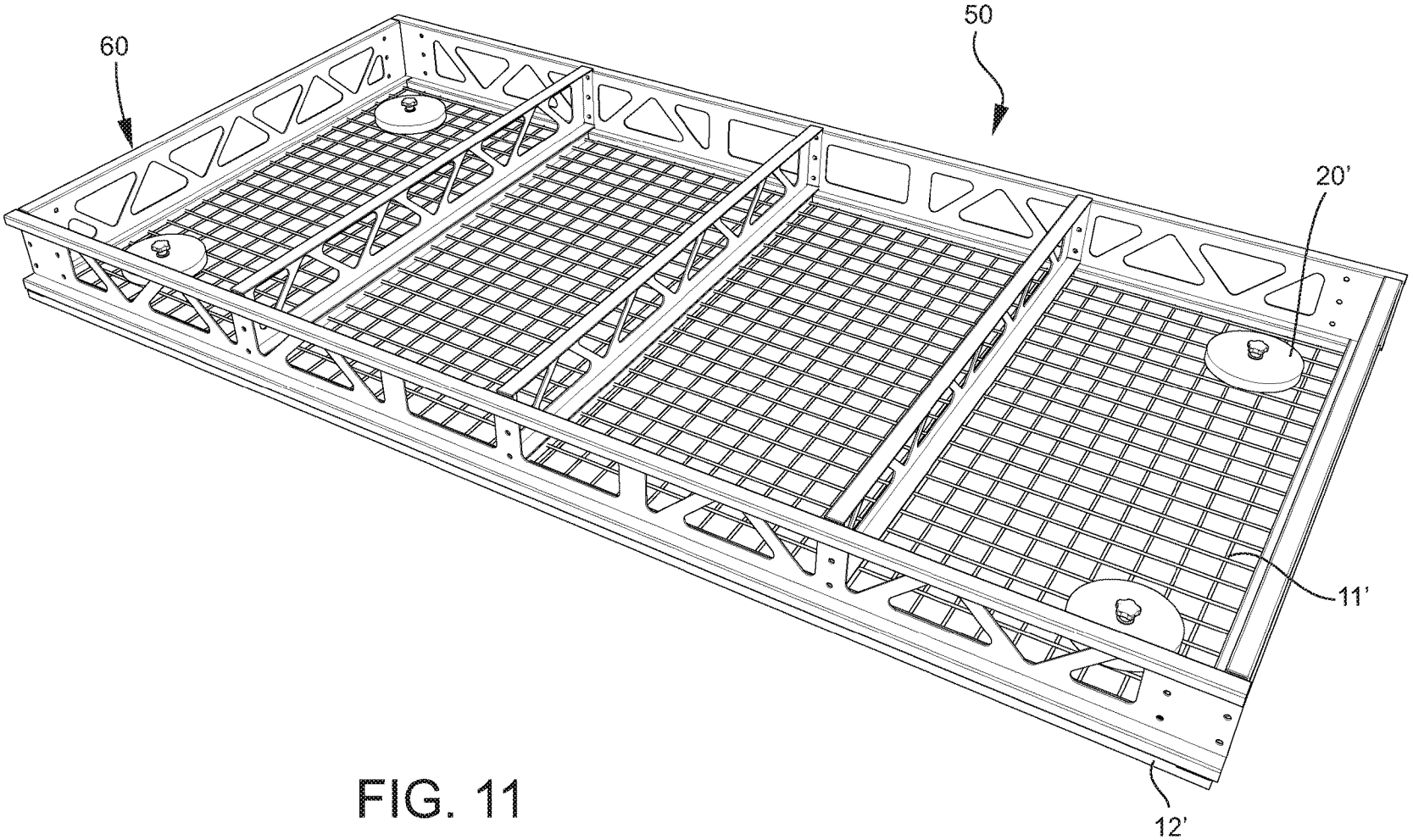
FIG. 11 is a perspective view showing an underside of the exemplary composite floor structure.
Figure 12:
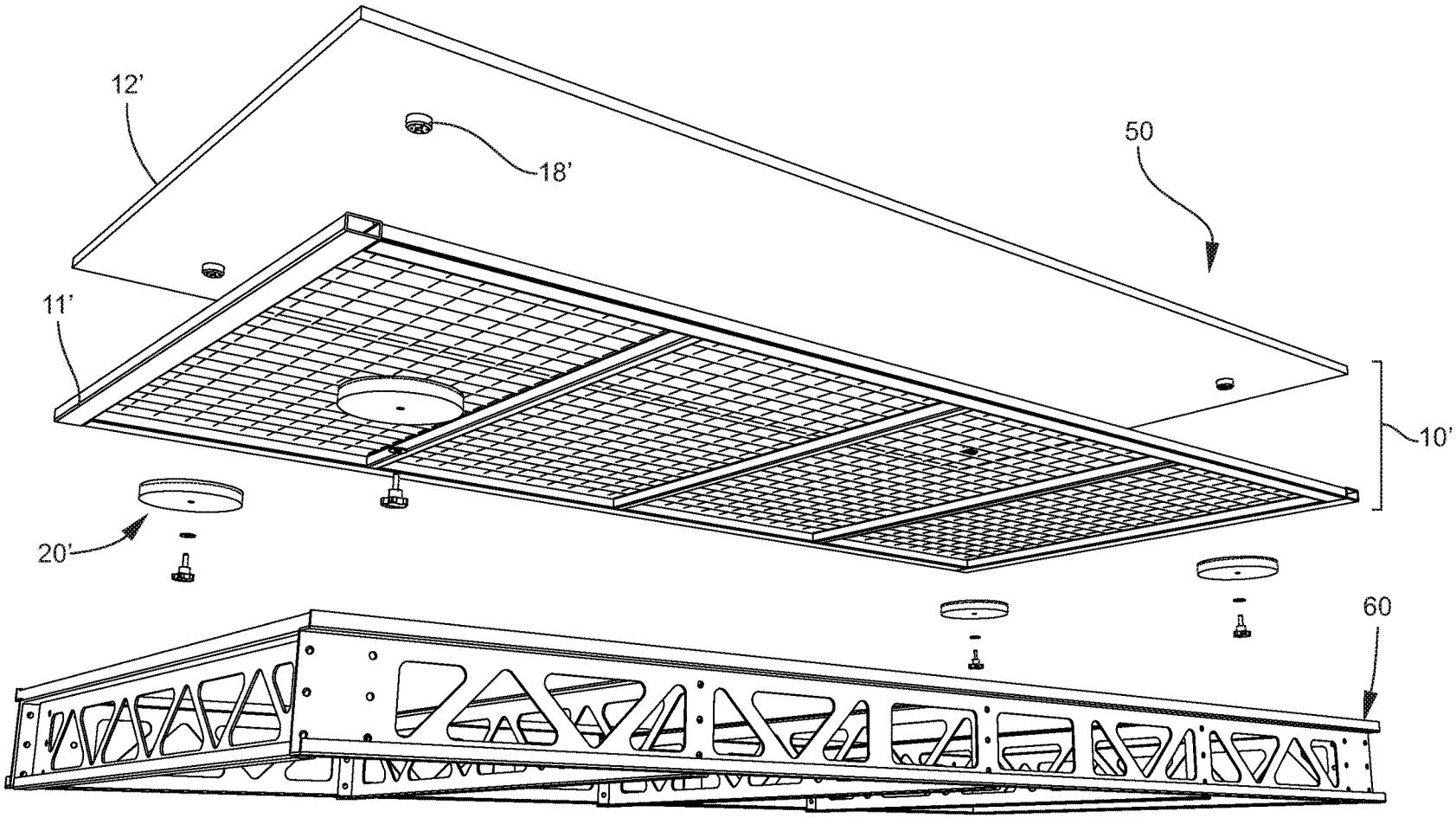
FIG. 12 is an exploded perspective view of the composite floor structure.
Figure 13:
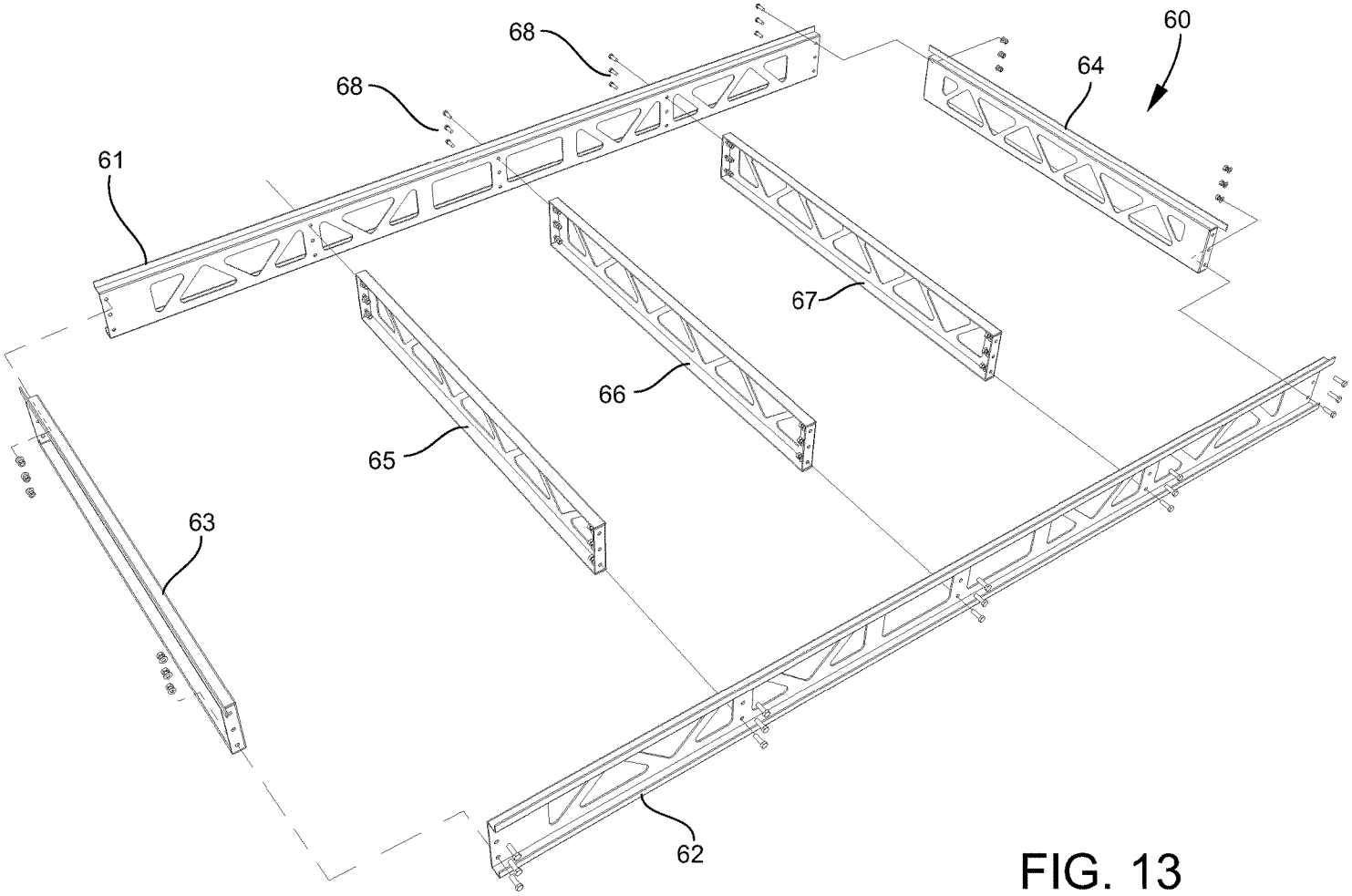
FIG. 13 is an exploded perspective view of the exemplary truss frame assembly.
Figure 14:
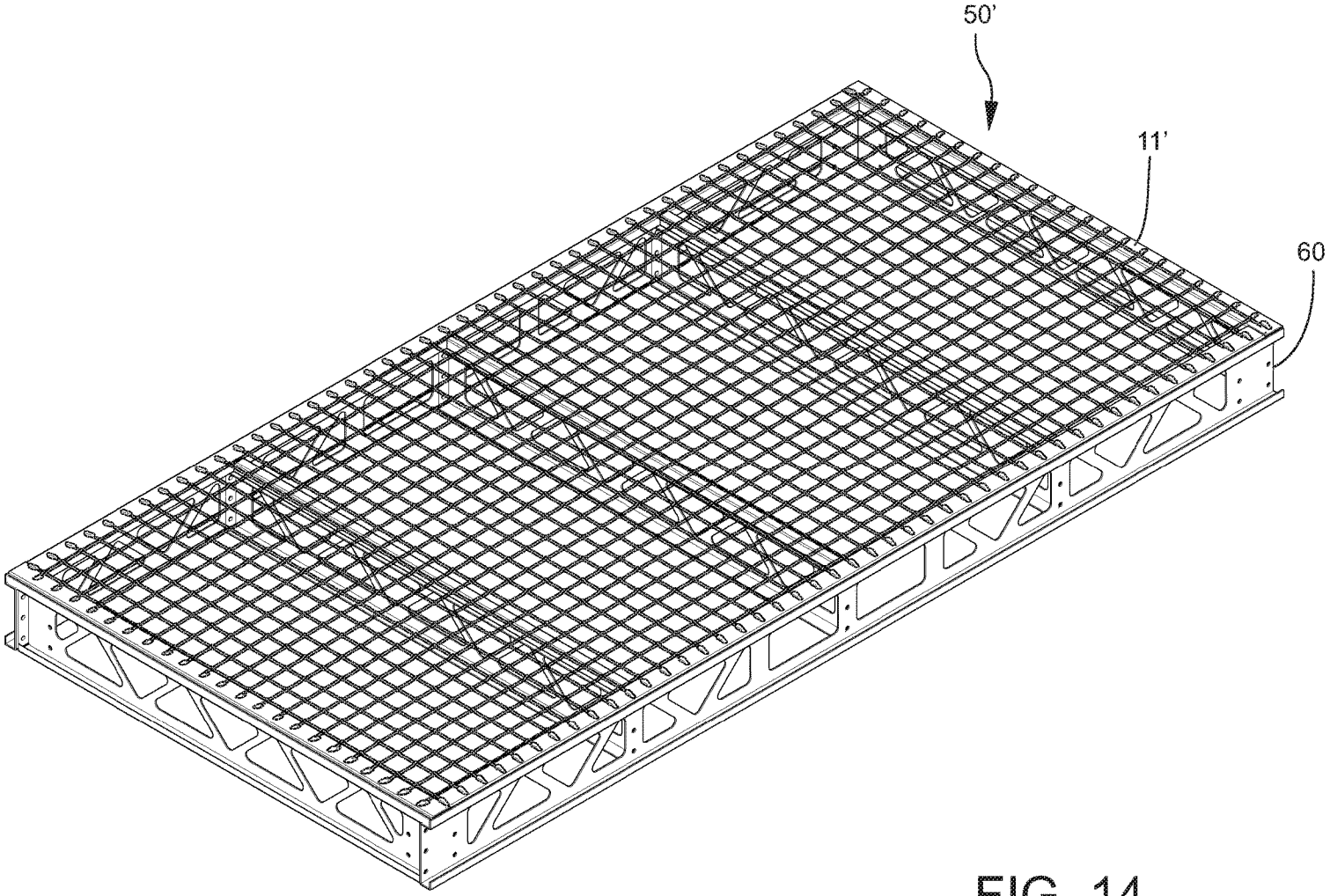
FIG. 14 is a perspective view of the composite floor structure converted (by removing the top polymer deck) to a substantially open-surface light and sound permeable structure.

Referring to FIGS. 9-13, in alternative exemplary embodiments, the present disclosure comprises a composite floor structure 50 incorporating a truss assembly 60 and convertible floor panel assembly 10' The floor panel assembly 10' is carried on the truss assembly 60, and may be identical to the panel assembly 10 described above. Like elements shown in the drawings are indicated in prime notation. As shown in FIGS. 10, 11, and 12, the exemplary floor panel assembly 10' incorporates a wire mesh subfloor 11' and a solid surface polymer deck 12'. The subfloor 11' and deck 12' are removably attached together by panel retainers 20' The exemplary truss assembly 60 is constructed of an arrangement of open-web beams. As best shown in FIG. 13, the truss assembly 60 comprises opposing longitudinal open-web side beams 61, 62, opposing open-web end beams 63, 64, and lateral open-web cross beams 65, 66, and 67. The beams 61-67 are integrally joined together using suitable fasteners 68. The floor panel assembly 10' is removably mounted to the truss assembly 60 by fasteners 69 (See FIG. 15). Alternatively, the composite floor structure 50' may be readily converted to a substantially open-surface sound and light permeable structure, as shown in FIG. 14, by unscrewing the panel retainers 20' and removing the solid surface deck 12' of the panel assembly 10'.

Figure 16:
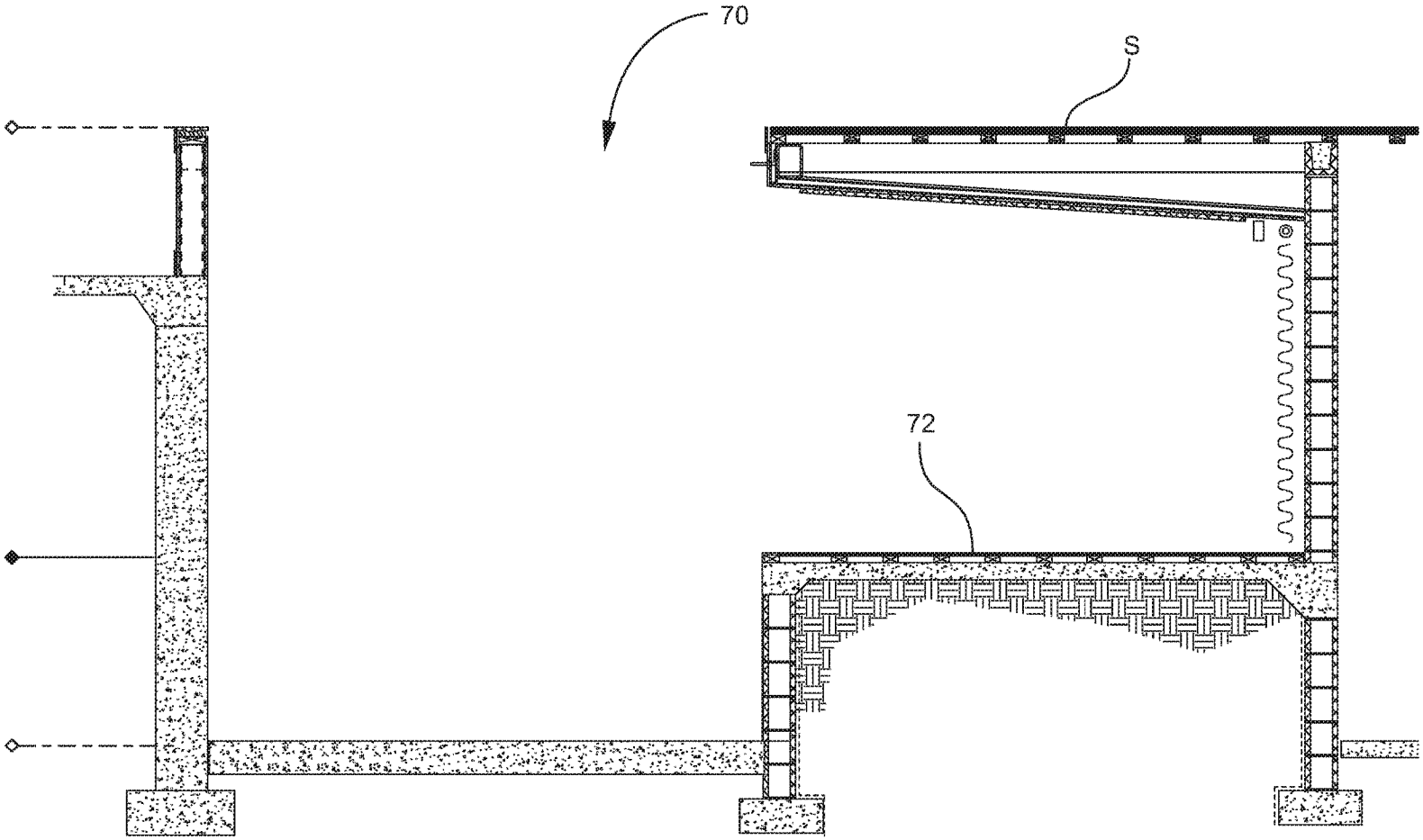
FIG. 16 illustrates an exemplary orchestra pit.
Figure 17:
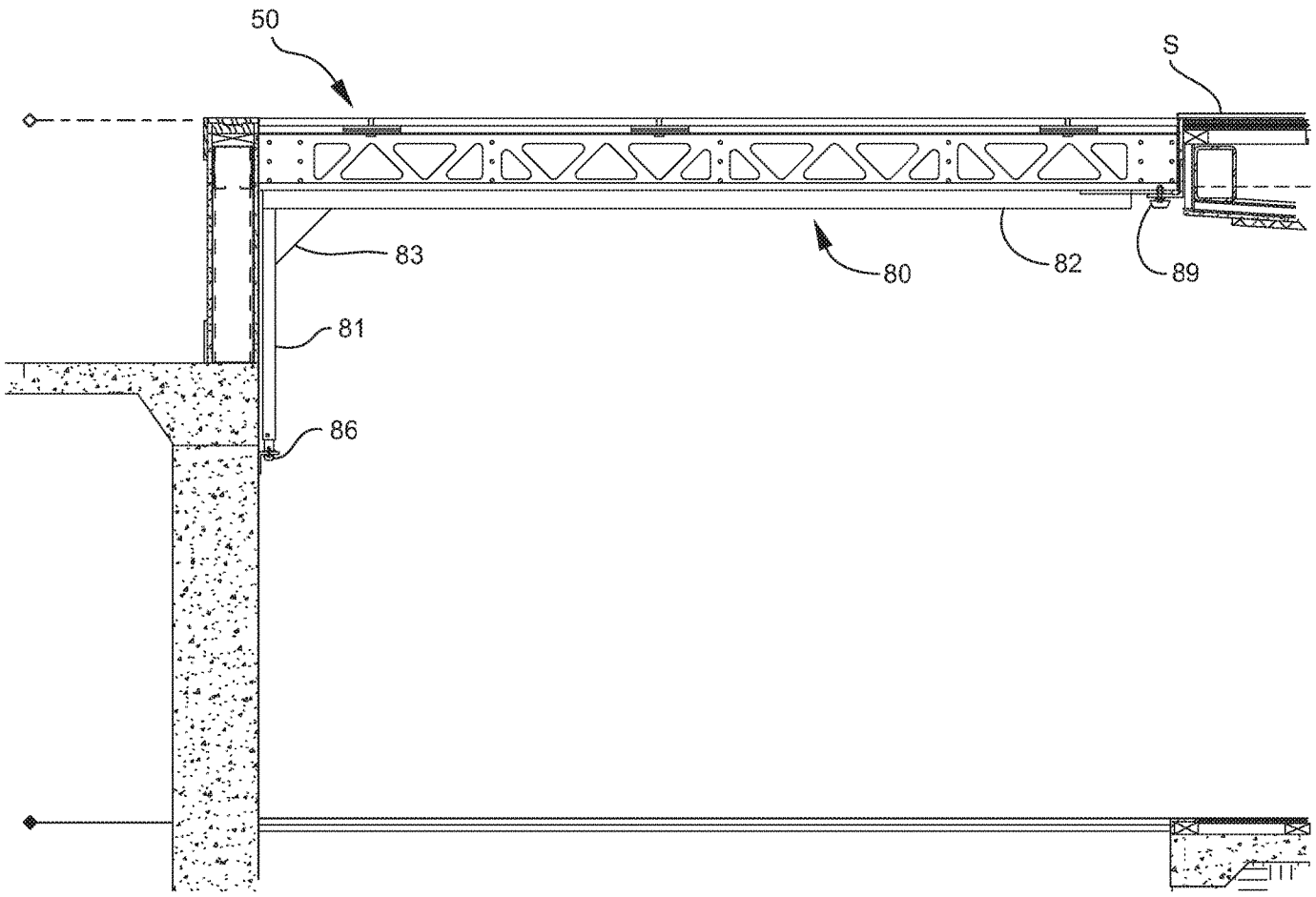
FIG. 17 shows the orchestra pit filled using the present composite floor structure.
Figure 19:
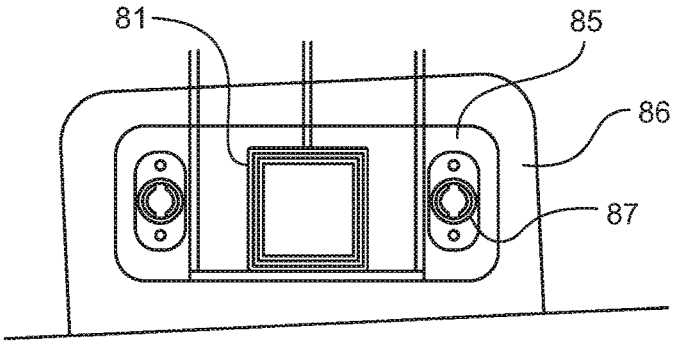
FIG. 19 is a plan view showing the wall bracket and vertical element of the supporting L-frame.
Figure 21:
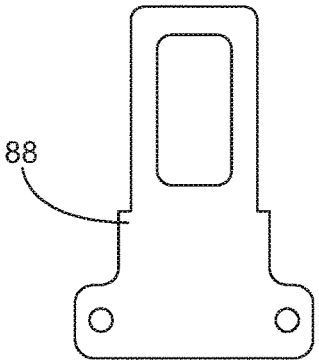
FIG. 21 is a plan view of the hammer-shaped mounting plate.
Figure 22:
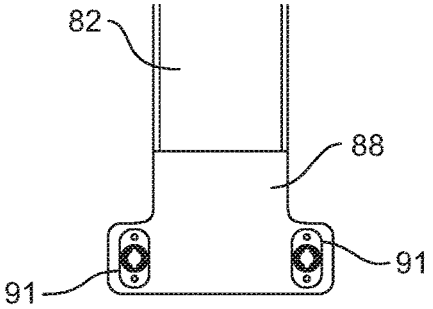
FIG. 22 is a plan view of the mounting plate attached to a distal end of the horizontal U-channel.
Figure 23:
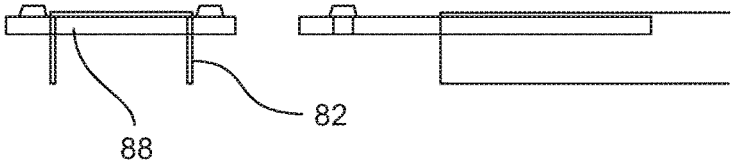
FIG. 23 is an end view of the mounting plate and horizontal U-channel.

The exemplary composite floor structure 50 may be used to temporarily fill the orchestral pit of a theater. As best shown in FIG. 16, the orchestra pit 70 is generally located in a lowered area in front of the stage "S" and comprises a seating area 72 for musicians. The exemplary floor structure 50 is designed to span the opening of the orchestral pit 70, as shown in FIG. 17, and is supported by a series of spaced-apart adjustable L-frames 80. Each L-frame 80 comprises a telescoping square-tube vertical member 81 and an elongated horizontal U-channel 82. Proximal ends of the vertical member and U-channel are joined together by fasteners (not shown) and braced by angled web 83. As best shown in FIGS. 17, 18 and 19, the distal end of vertical member 81 is welded to a mounting plate 85 and attached to a wall bracket 86 by fasteners 87 (e.g., cam lock or other quick release fasteners).

Figure 15:
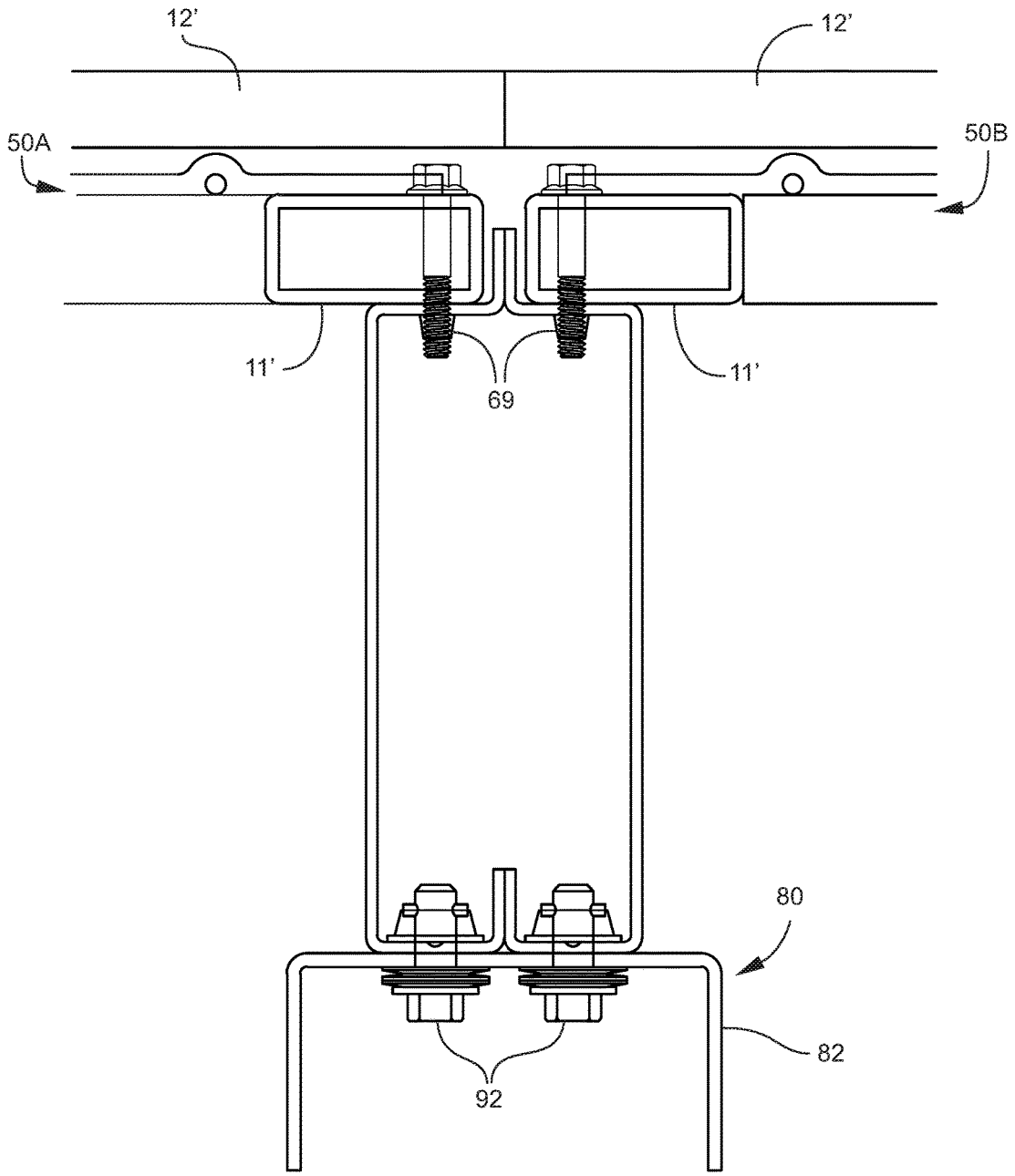
FIG. 15 is a cross-sectional view demonstration interconnection of adjacent floor structures to a common support element.

Referring to FIGS. 17 and 20-23, the distal end of U-channel 82 is supported by a cantilevered hammer-shaped mounting plate 88 (FIG. 21) extending from a wall sill 89 located at a front end of the stage "S". The mounting plate 88 may be attached to the wall sill 89 using cam lock or other quick release fasteners 91. In the present embodiment, a single L-frame 80 is located at the seam between adjacent floor structures 50A, 50B, as shown in FIG. 15, and interconnects the adjacent floor structures using fasteners 92.

Figure 24:
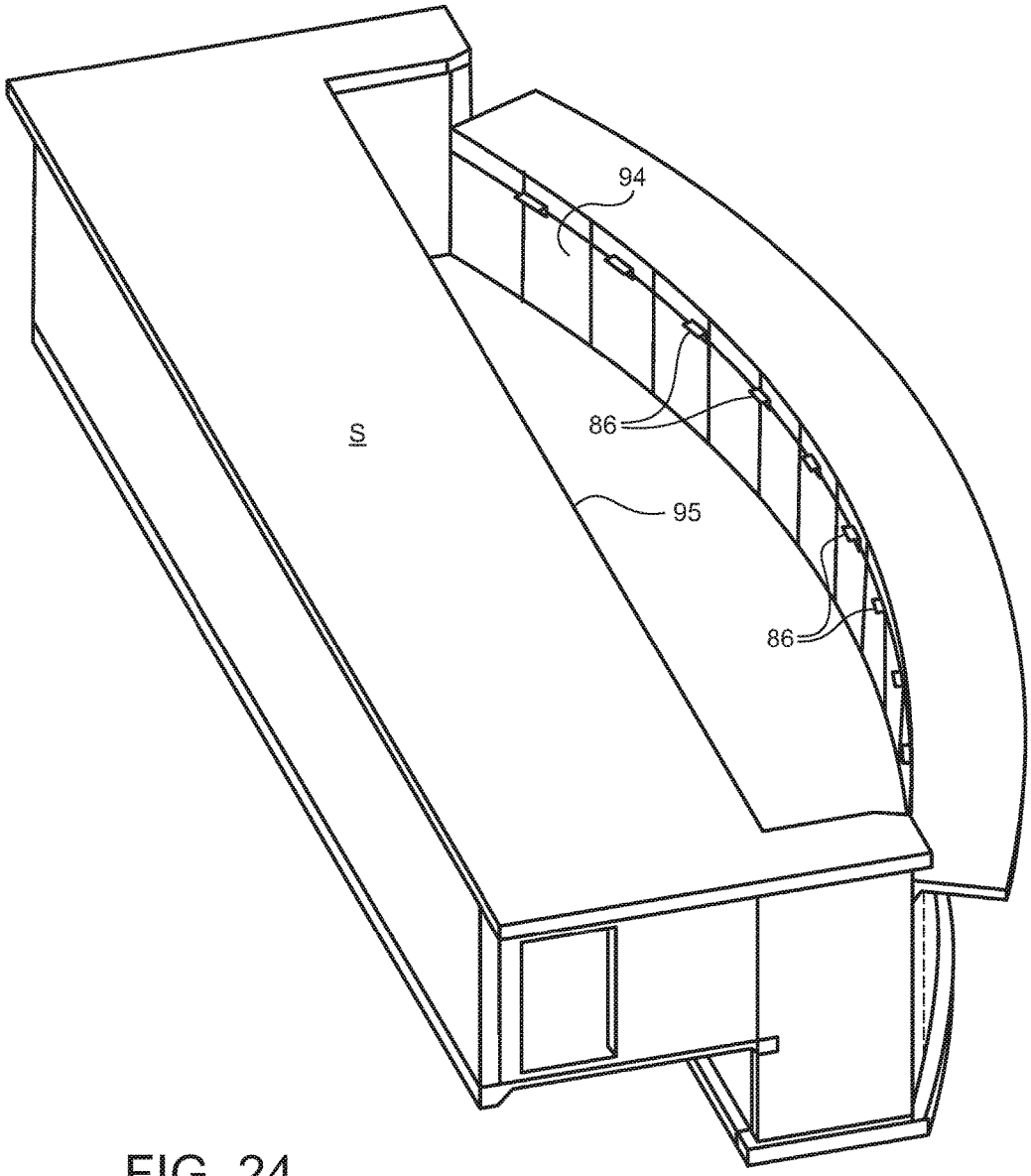
FIGS. 24-31 demonstrate exemplary steps in the installation and assembly of composite floor structures used to fill an orchestral opening adjacent a theater stage.
Figure 25:
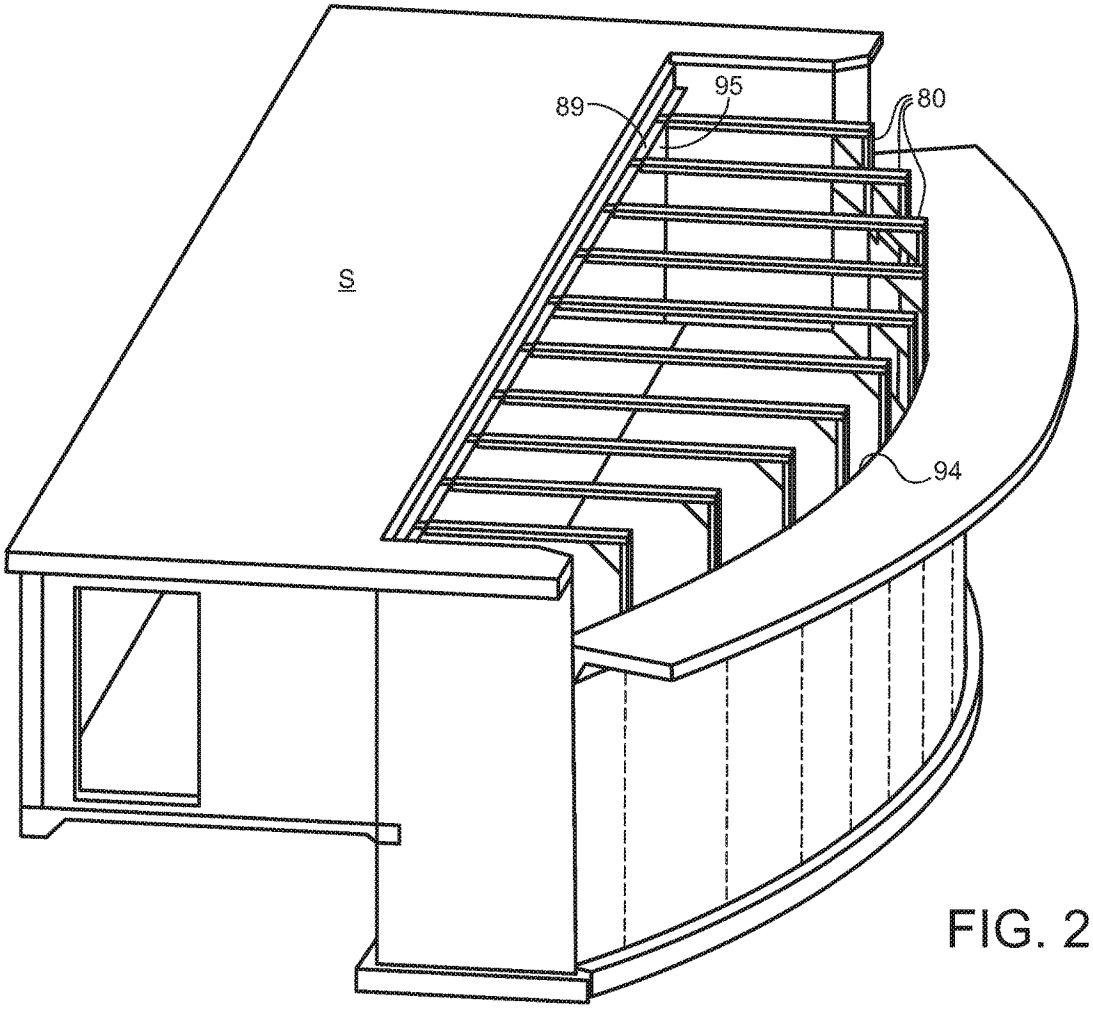
Figure 26:
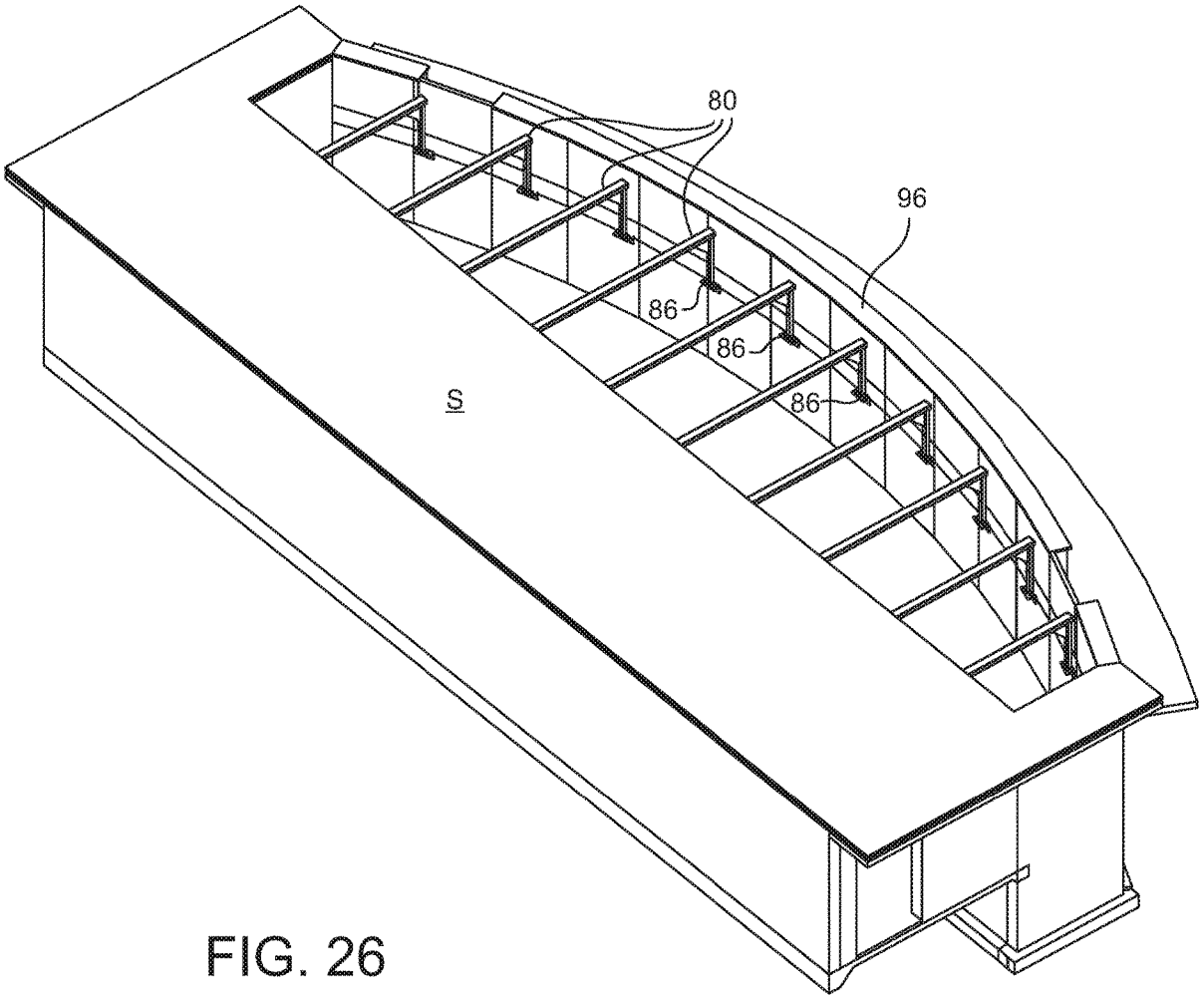
Figure 27:
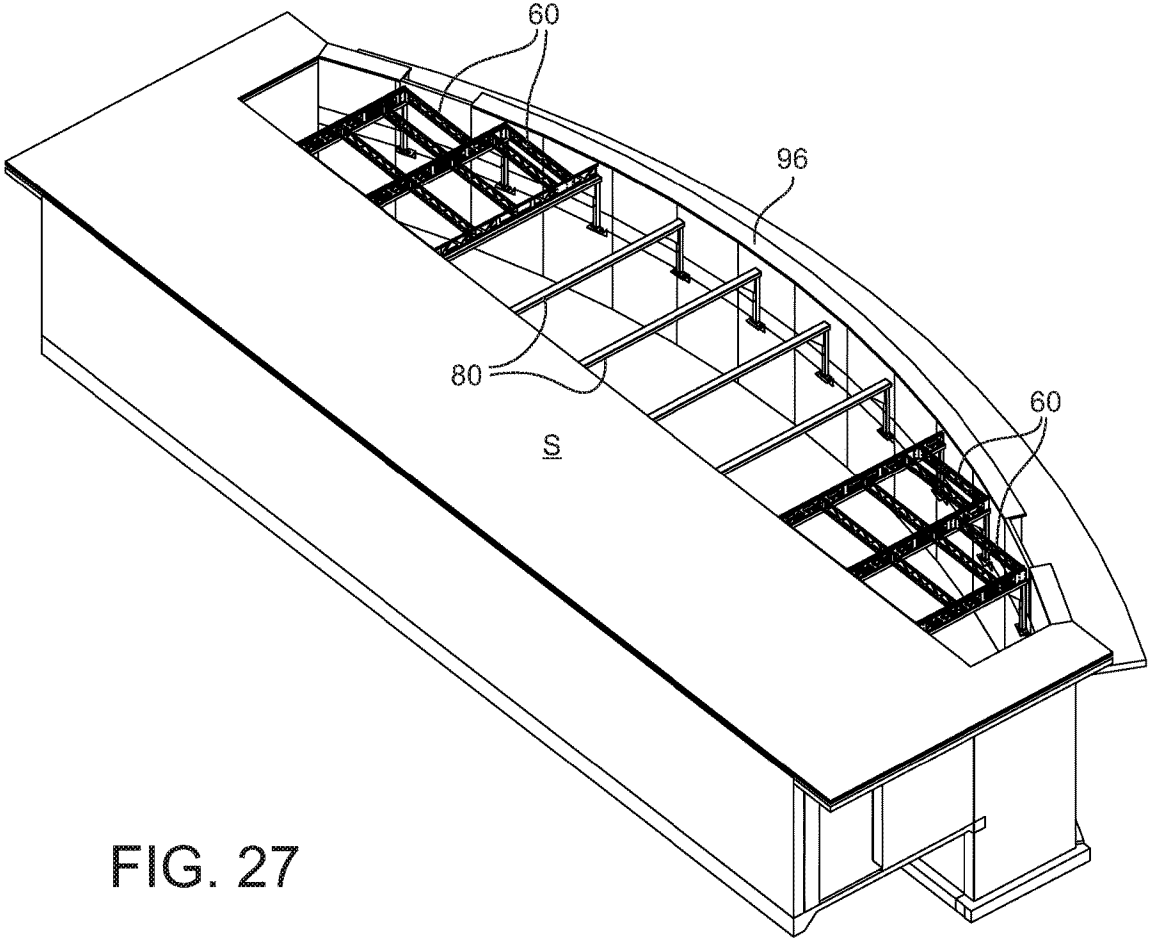
Figure 28:
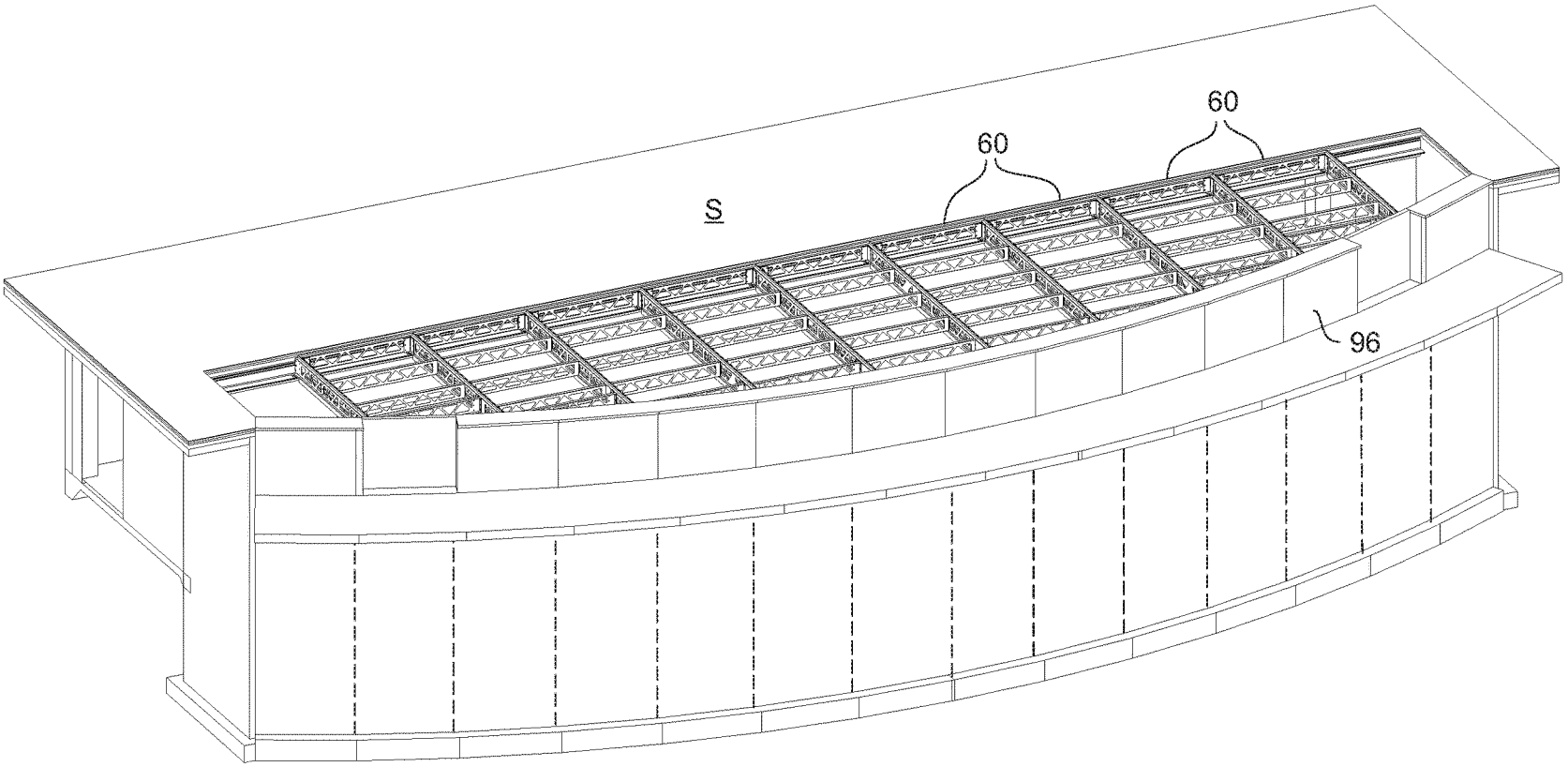
Figure 29:
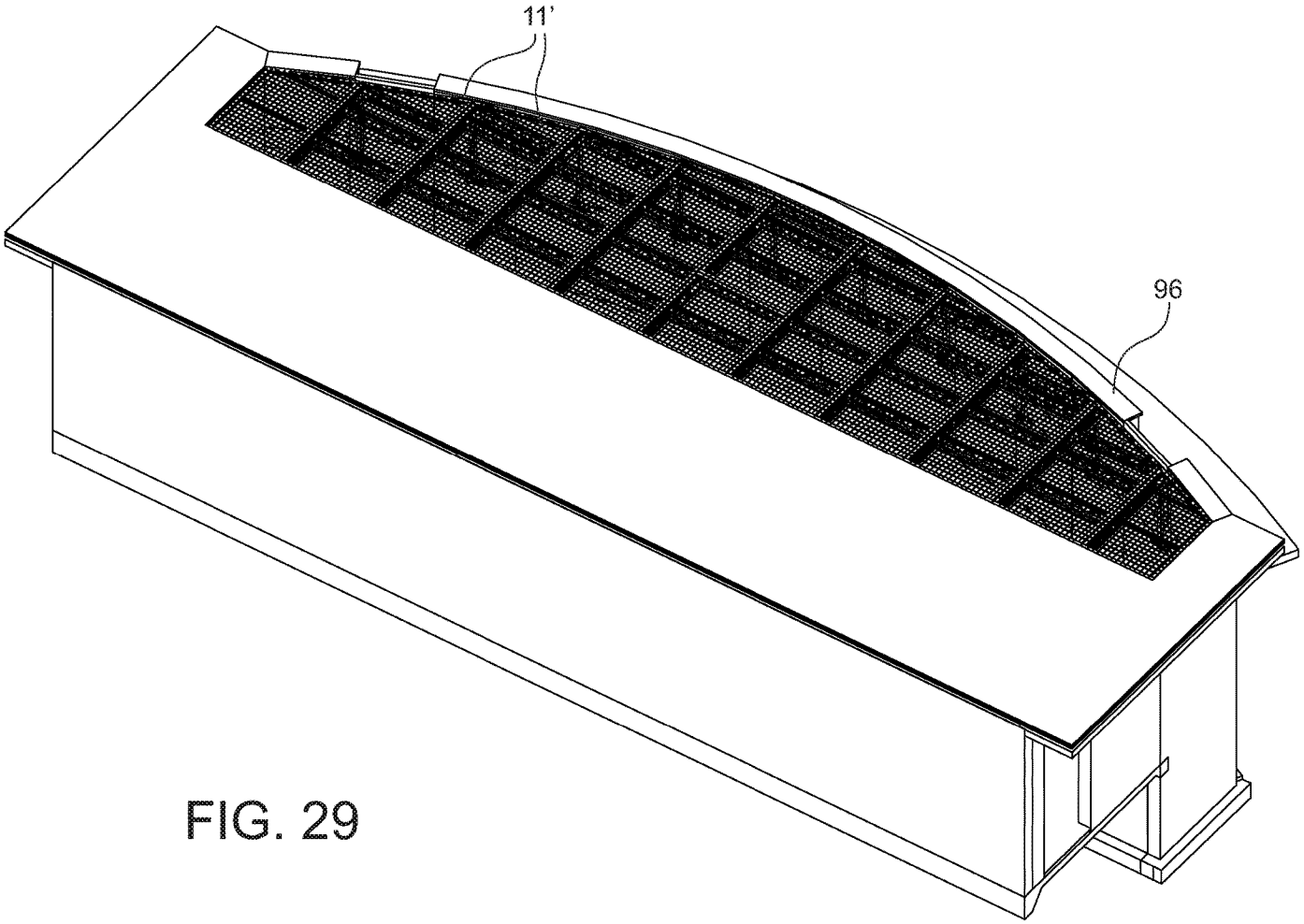
Figure 30:
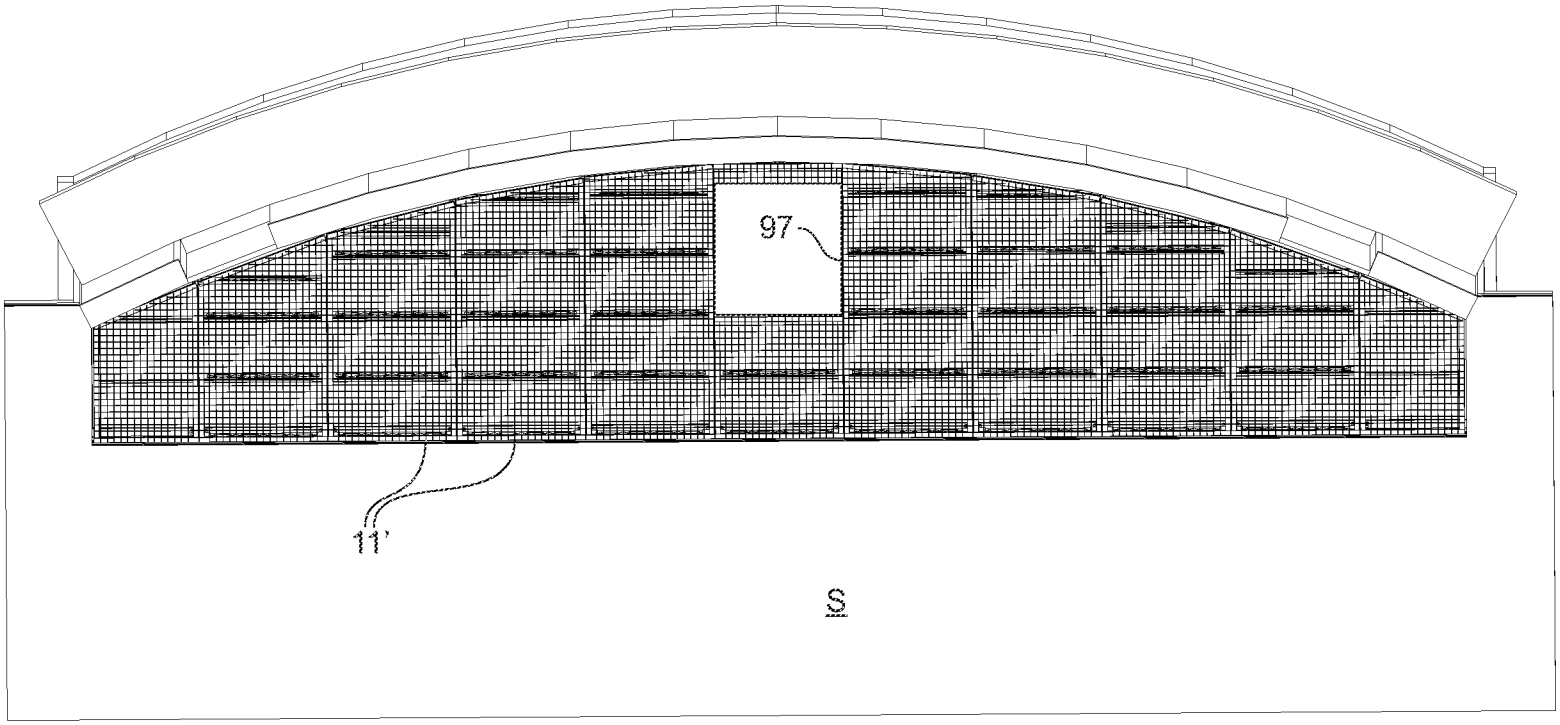
Figure 31:
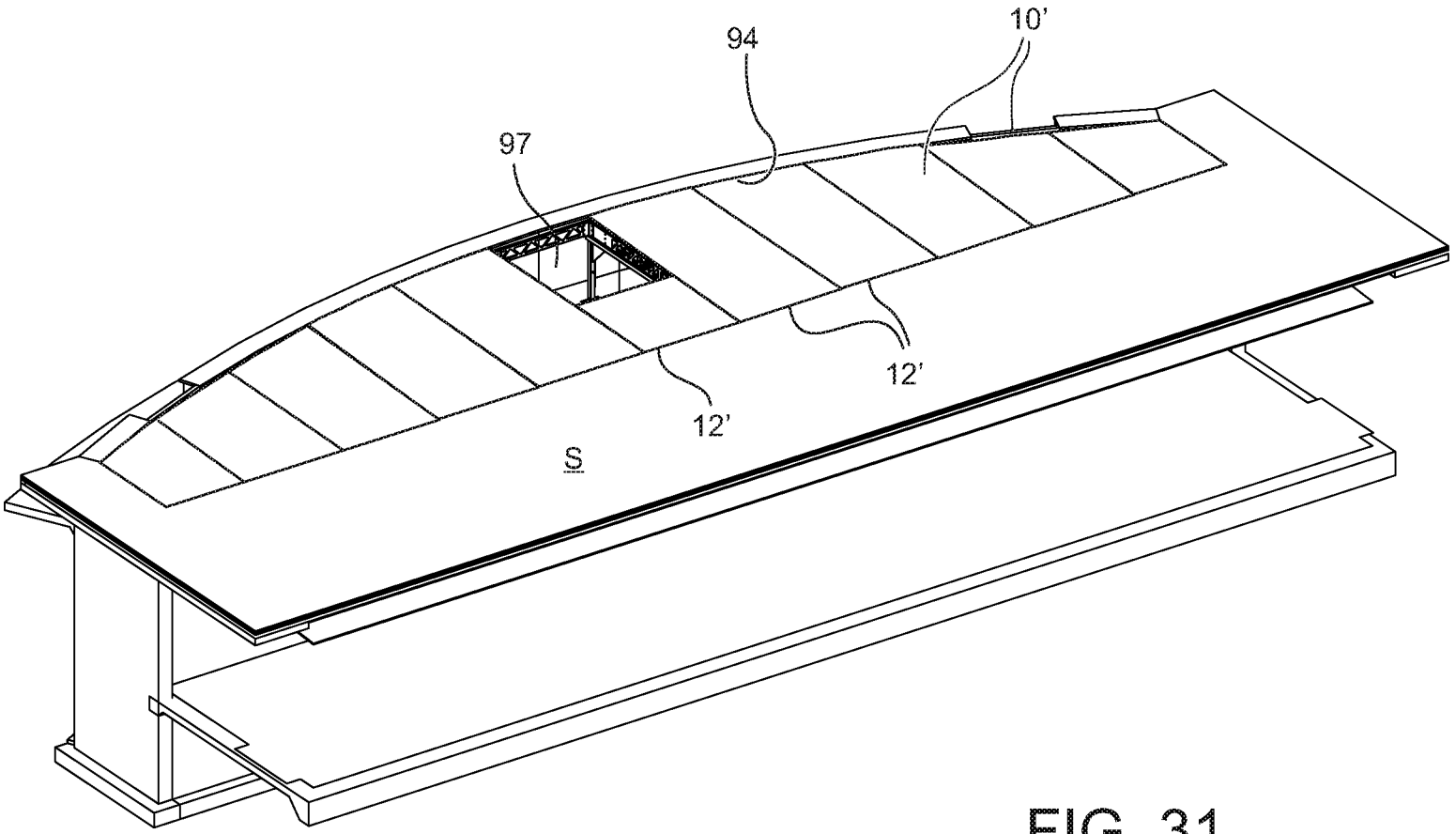
Figure 32:
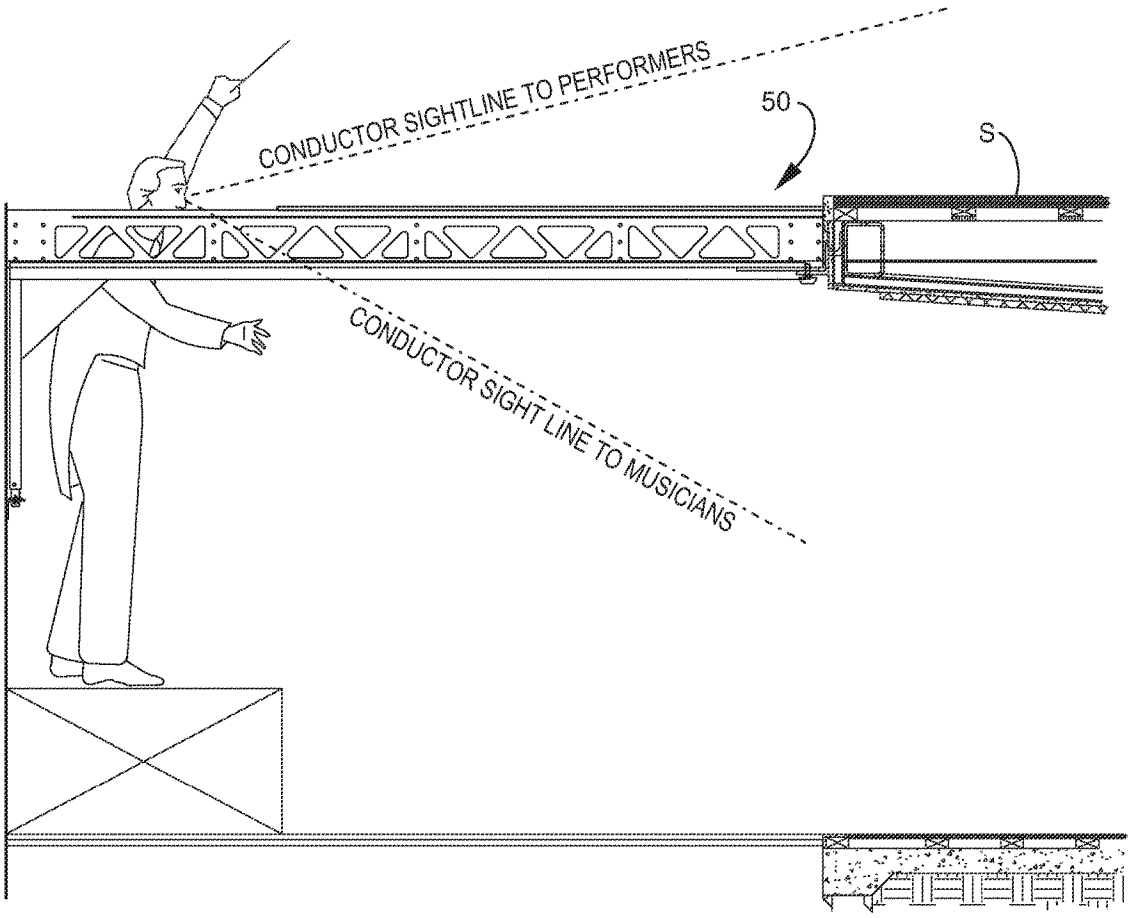
FIG. 32 shows the sight line of the conductor relative to the stage and orchestra area.

FIGS. 24-31 demonstrate installation and assembly of multiple floor structures 50 in filling the orchestral opening adjacent a theater stage "S". As best shown in FIGS. 24 and 25, the orchestral opening is defined by a generally arcuate front side 94 nearest the audience and a substantially linear back side 95 adjacent a front edge of the stage "S". Construction begins by installing the L-frames 80 at spaced intervals from one end of the orchestral opening to the other. See FIGS. 25 and 26. The L-frames 80 are uniformly spaced and supported by respective wall brackets 86 and the sill 89, as described above. Once the L-frames 80 are installed, a panel knee wall 96 shown in FIG. 26 is assembled along the front side 94 of the orchestral opening. The truss assemblies 60 are then mounted to the L-frames 80 as shown in FIGS. 27 and 28. The wire mesh subfloor 11' of panel assemblies can then be fastened to the truss assemblies 60 to form a continuous, substantially open-surface sound and light permeable safety structure. See FIGS. 29 and 30. A conductor hatch (or opening) 97 may also be formed with subfloor 11', as shown in FIG. 30. For added live and dead load capacity, the solid surface polymer deck 12' may be applied to the subfloor 11', as shown in FIG. 31, and retained by panel retainers 20' as previously described. The ends of floor panel assemblies 10' immediately adjacent the front side 94 of the orchestral opening may be custom-formed to match the curvature of the pit wall. The conductor hatch 97 allows the conductor to see what is happening on stage "S" (See FIG. 32), and to be readily seen by all of the musicians sitting inside the pit on chairs or bleachers.

Figure 33:
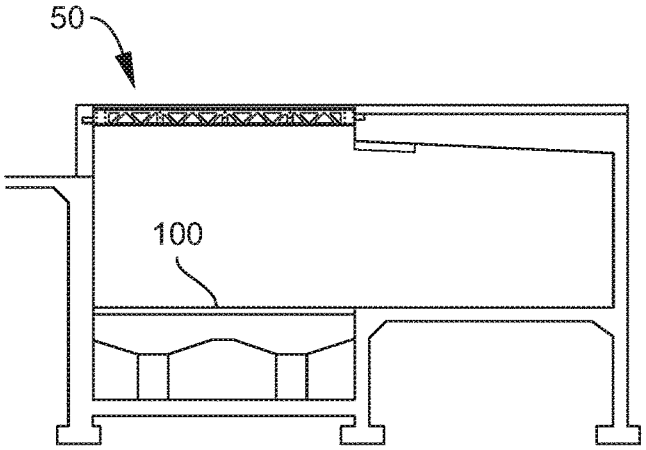
FIGS. 33-36 illustrate exemplary applications of the present composite floor structure in combination with a vertical pit lift.
Figure 34:
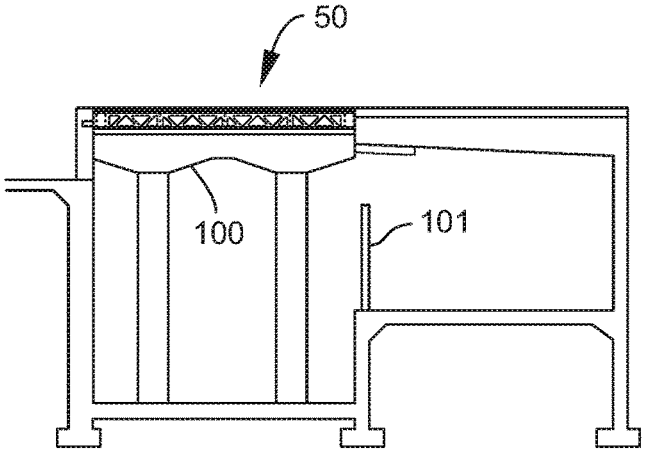
Figure 35:
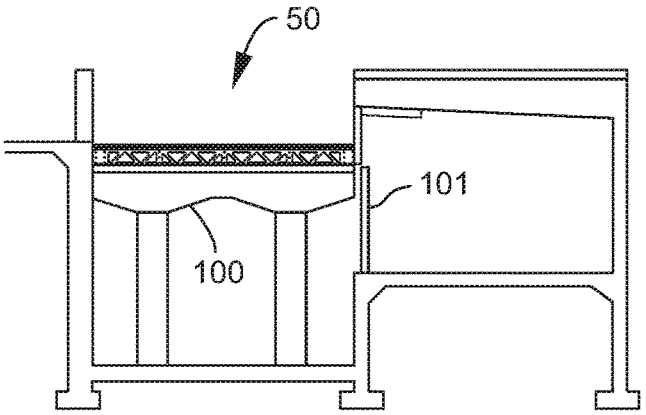
Figure 36:
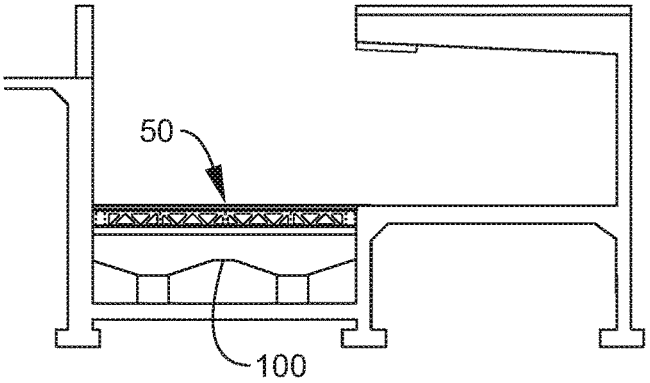

Referring to FIGS. 33-36, the exemplary floor structure 50 may be used in combination with an orchestra pit lift 100 applicable for lifting and lowering the floor structure 50 between multiple different elevations—a protected orchestra position shown in FIG. 33, a stage position shown in FIG. 34, a seating position shown in FIG. 35, and an open orchestra position shown in FIG. 36. In the protected orchestra position, the floor structure 50 is pinned to the knee wall and front edge of the stage, while the pit lift 100 is retracted to define a continuous supporting surface for the conductor and musicians. In the stage position, the pit lift 100 is elevated and carries the floor structure 50 at stage level, while safety guard rail 101 blocks access to an area below the lift 100. In the seating position, the pit lift 100 is retracted to position the floor structure 50 just below the stage surface, and supports the floor structure 50 to accommodate additional seating between the knee wall and stage. Safety guard rail 101 blocks access to an area below the lift 100. In the open orchestra position, the pit lift 100 is fully retracted to position the floor structure 50 immediately adjacent the musician seating area.

Figure 37:
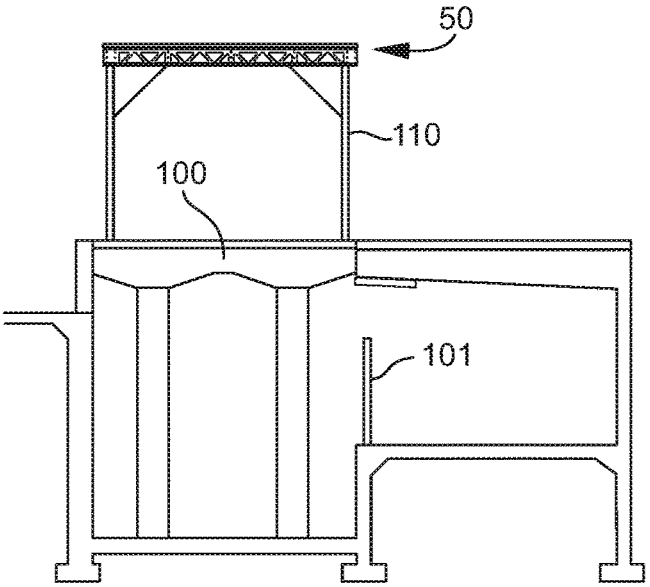
FIGS. 37 and 38 illustrate further exemplary applications of the present composite floor structure in combination with a vertical pit lift and frame.
Figure 38:
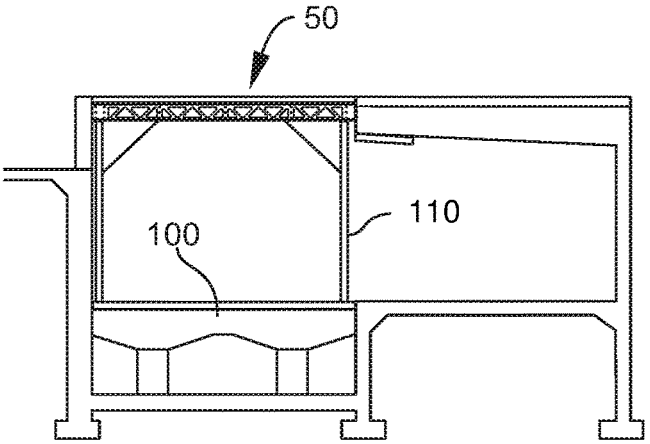
Figure 39:
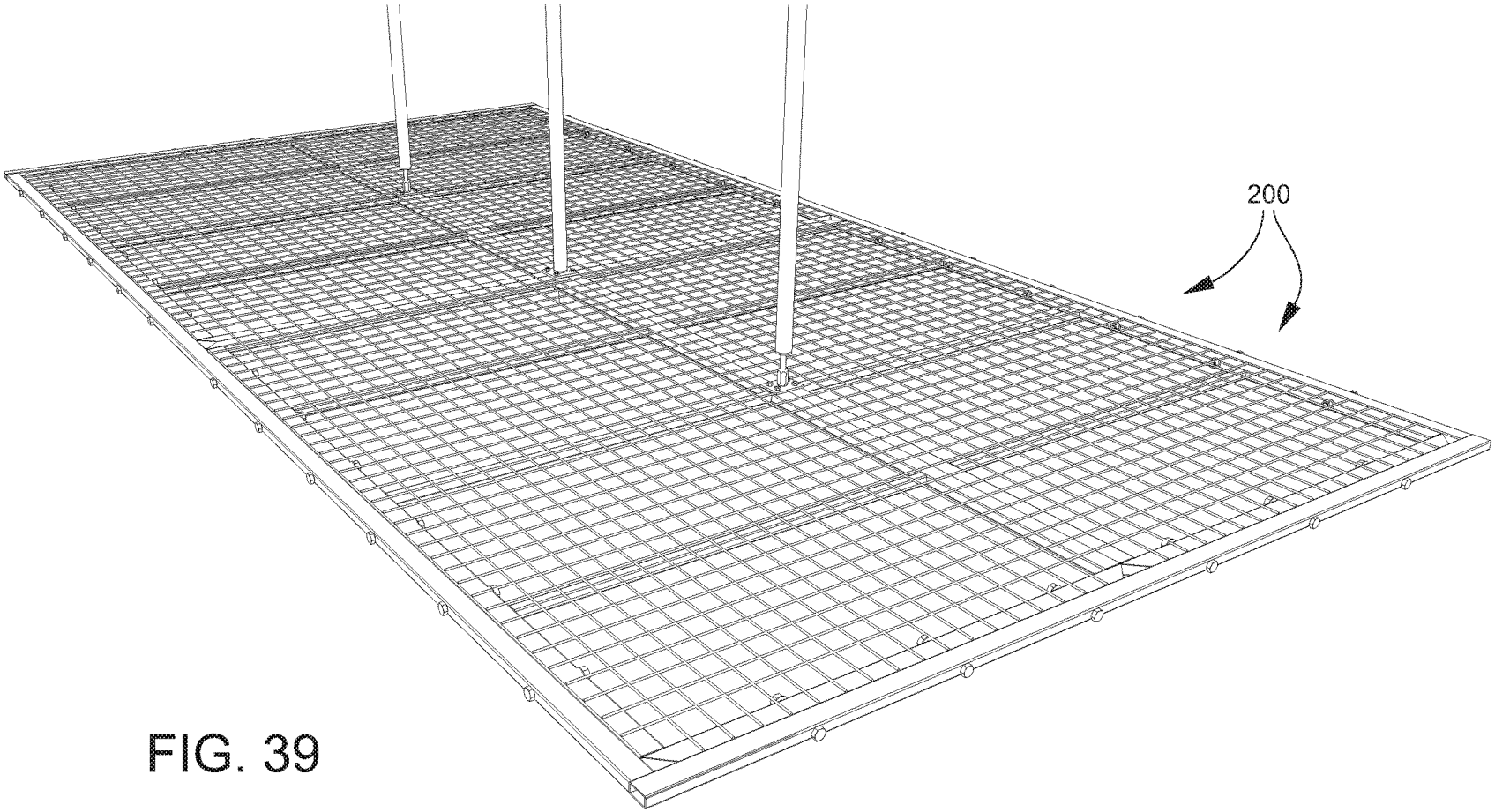
FIGS. 39-50 demonstrate sequential assembly and installation of exemplary lighting grid panels in a black box theater.
Figure 40:
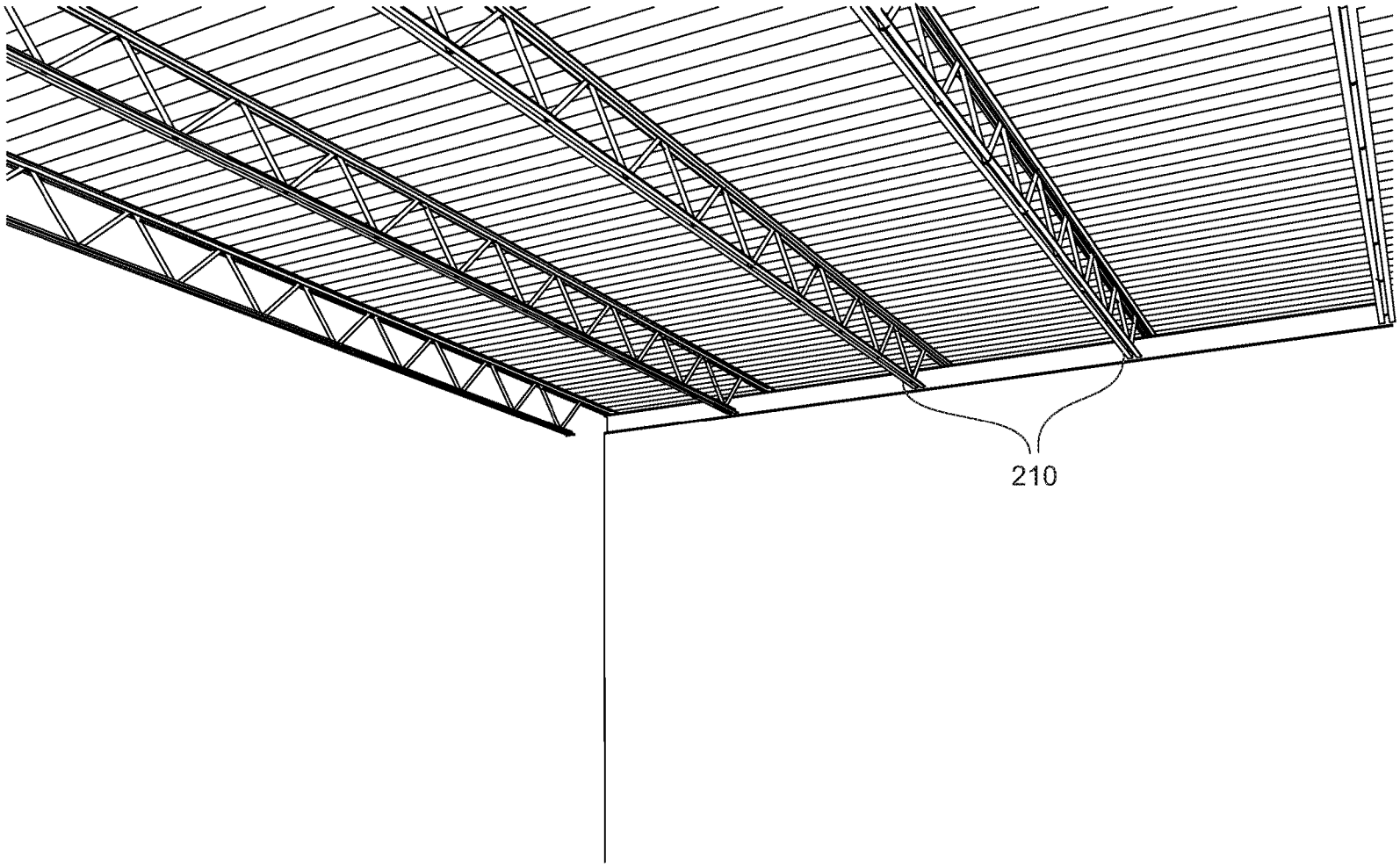
Figure 41:
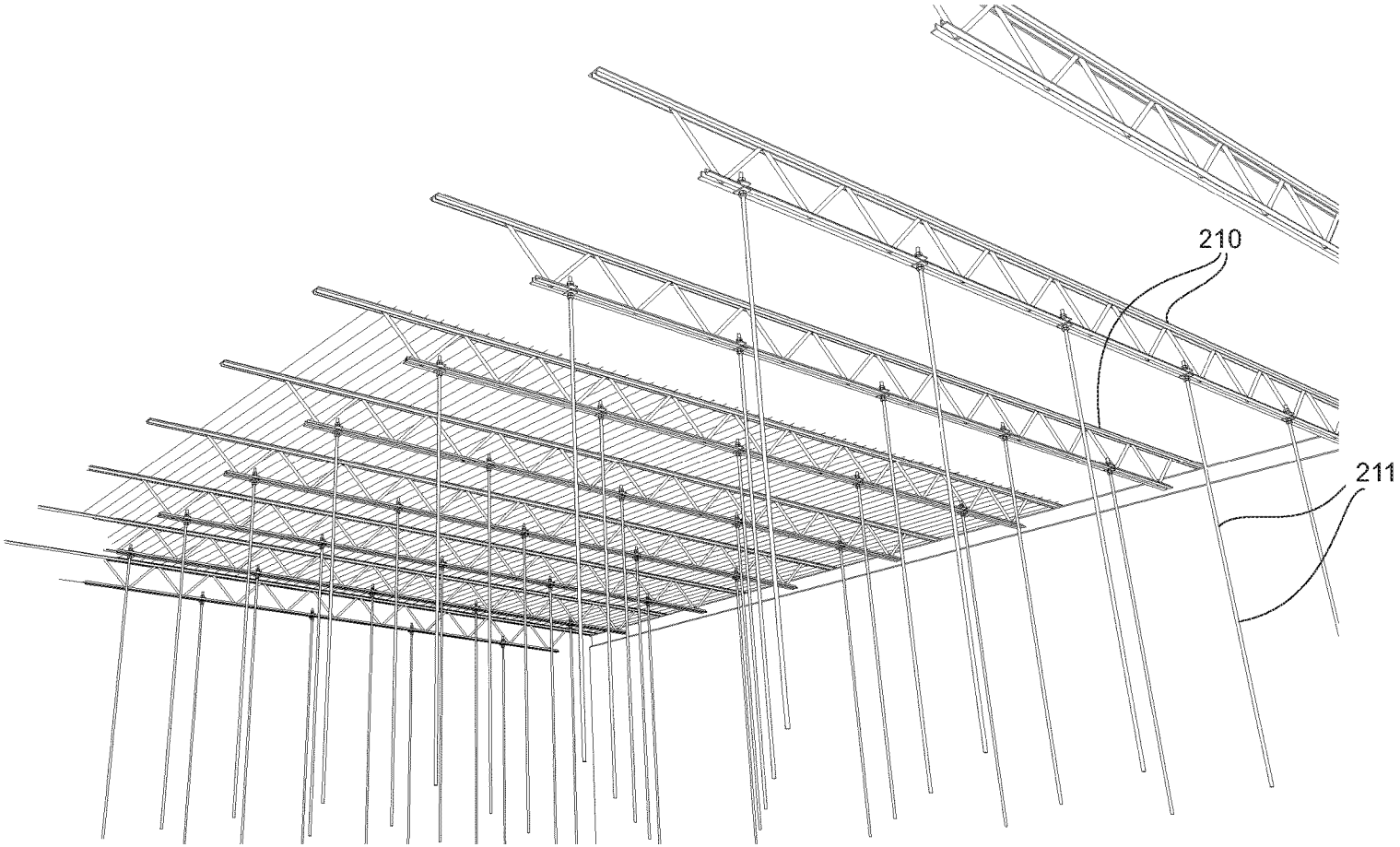
Figure 42:
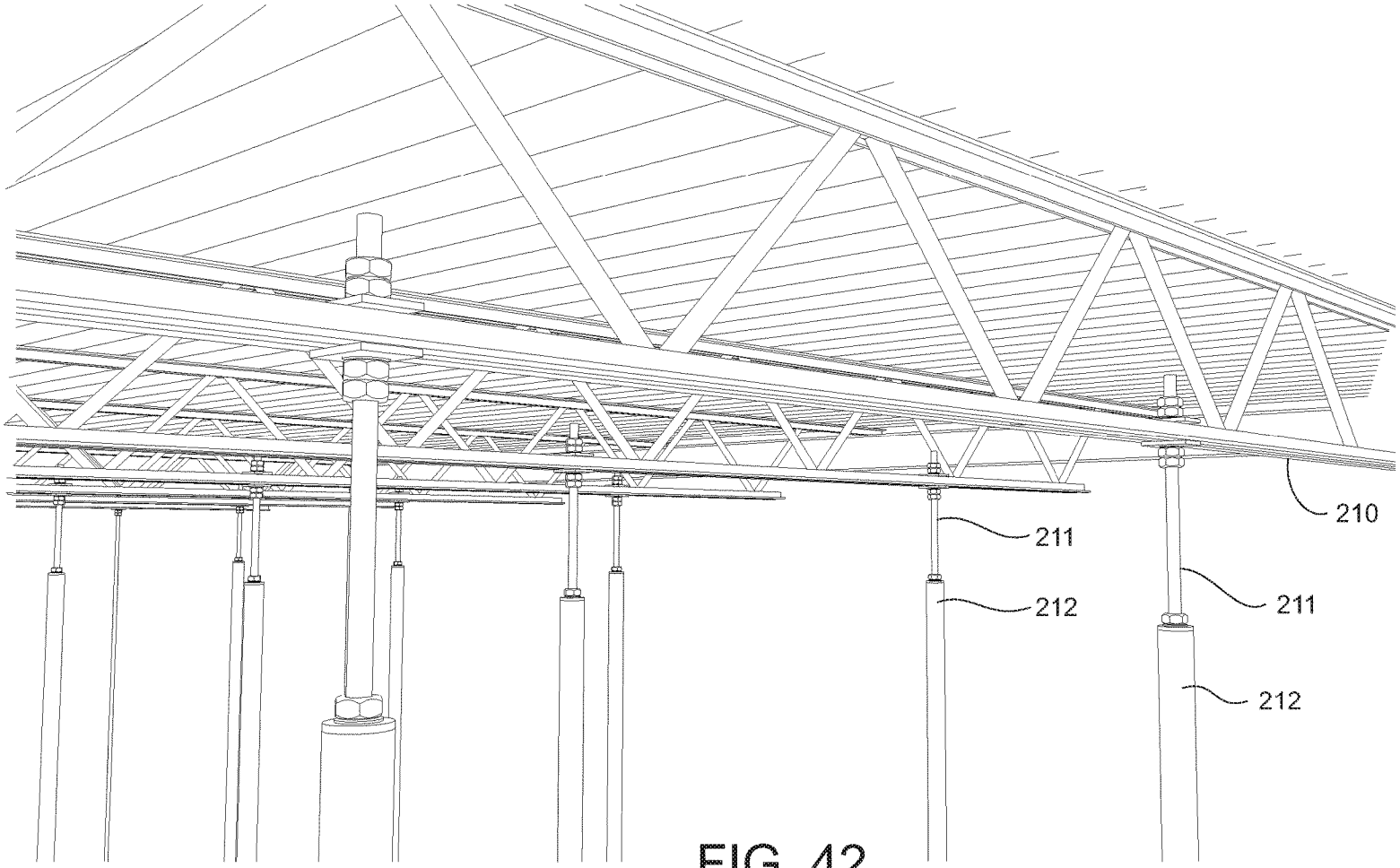
Figure 43:
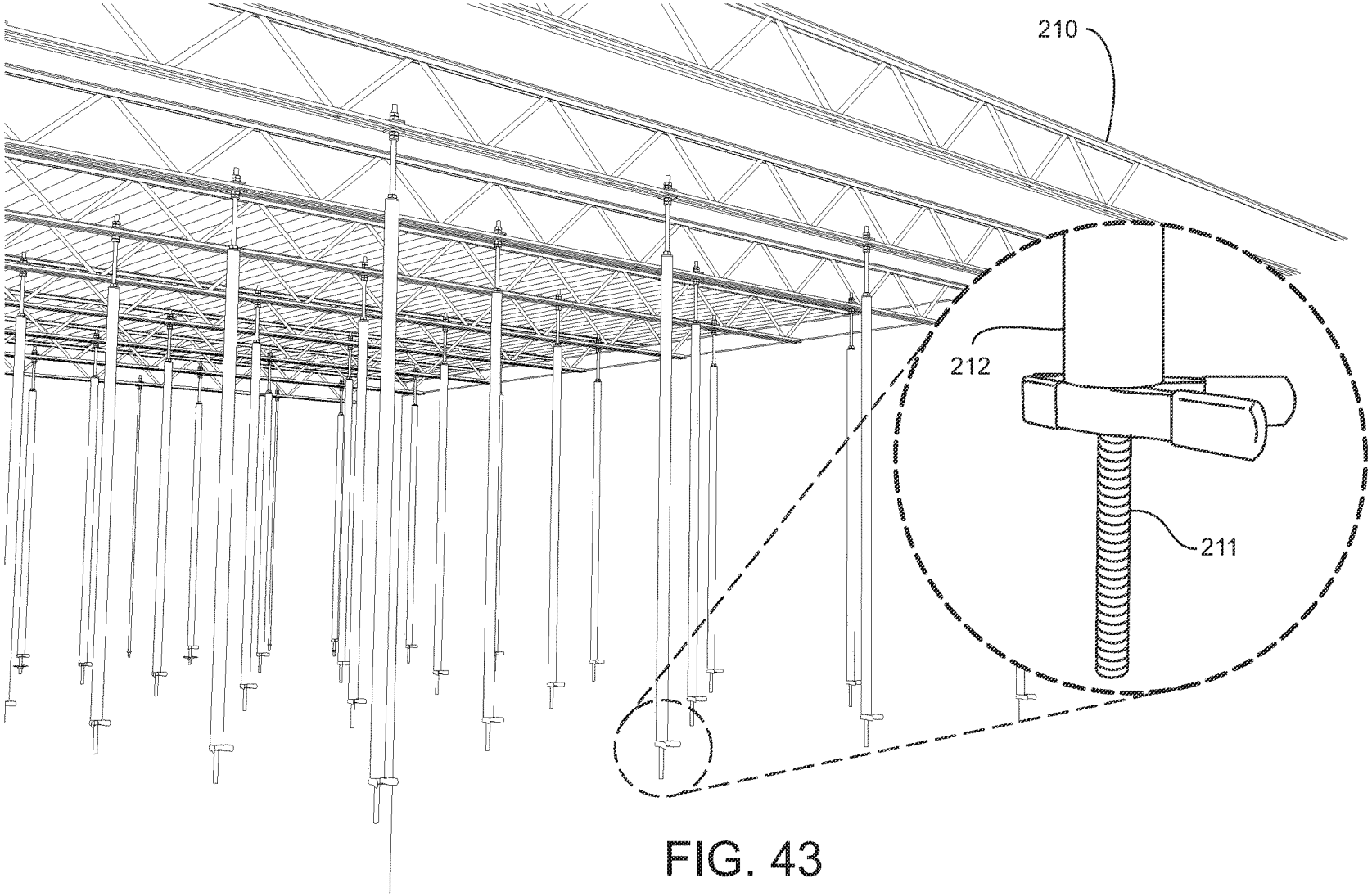
Figure 44:
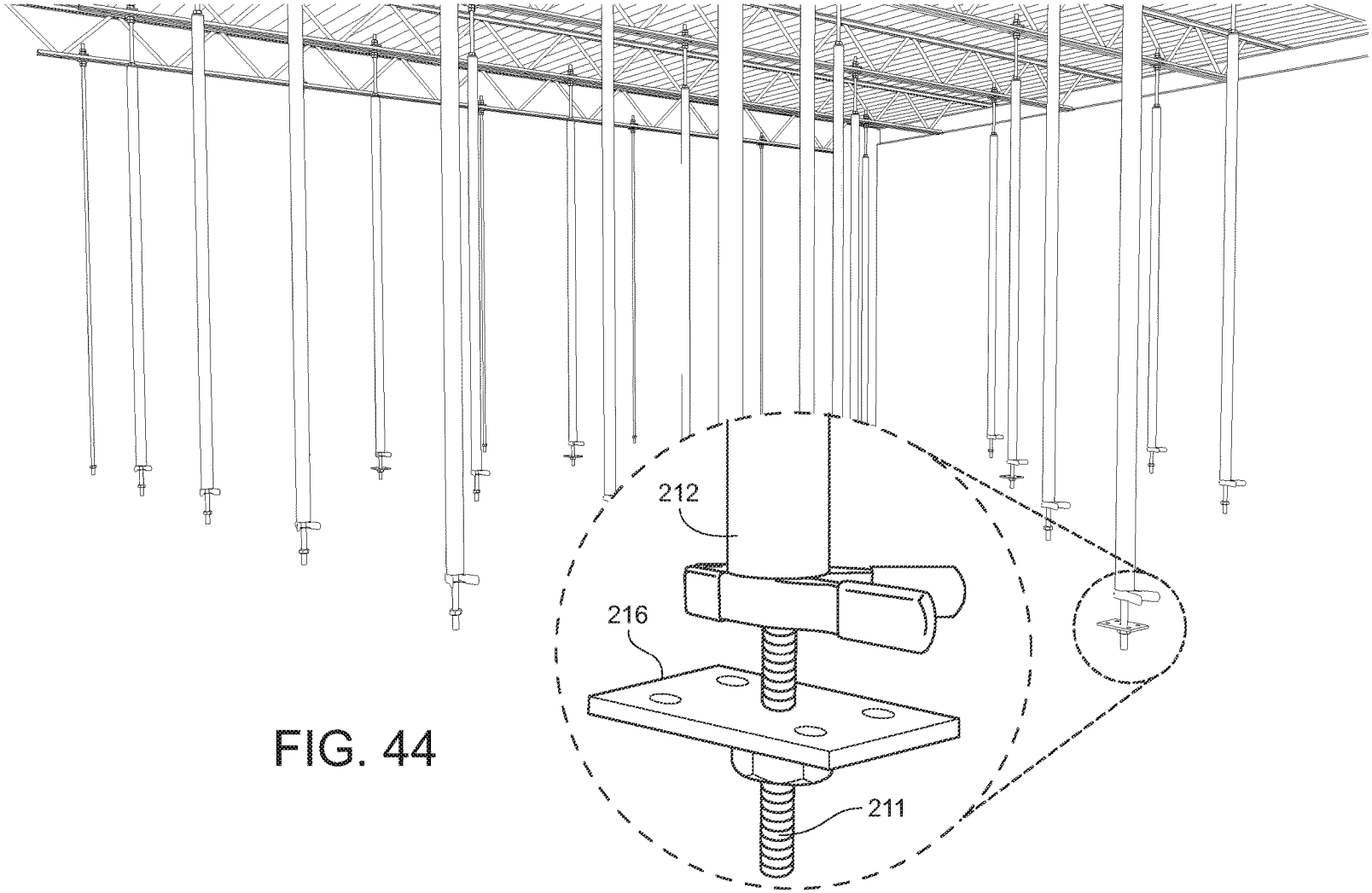
Figure 45:
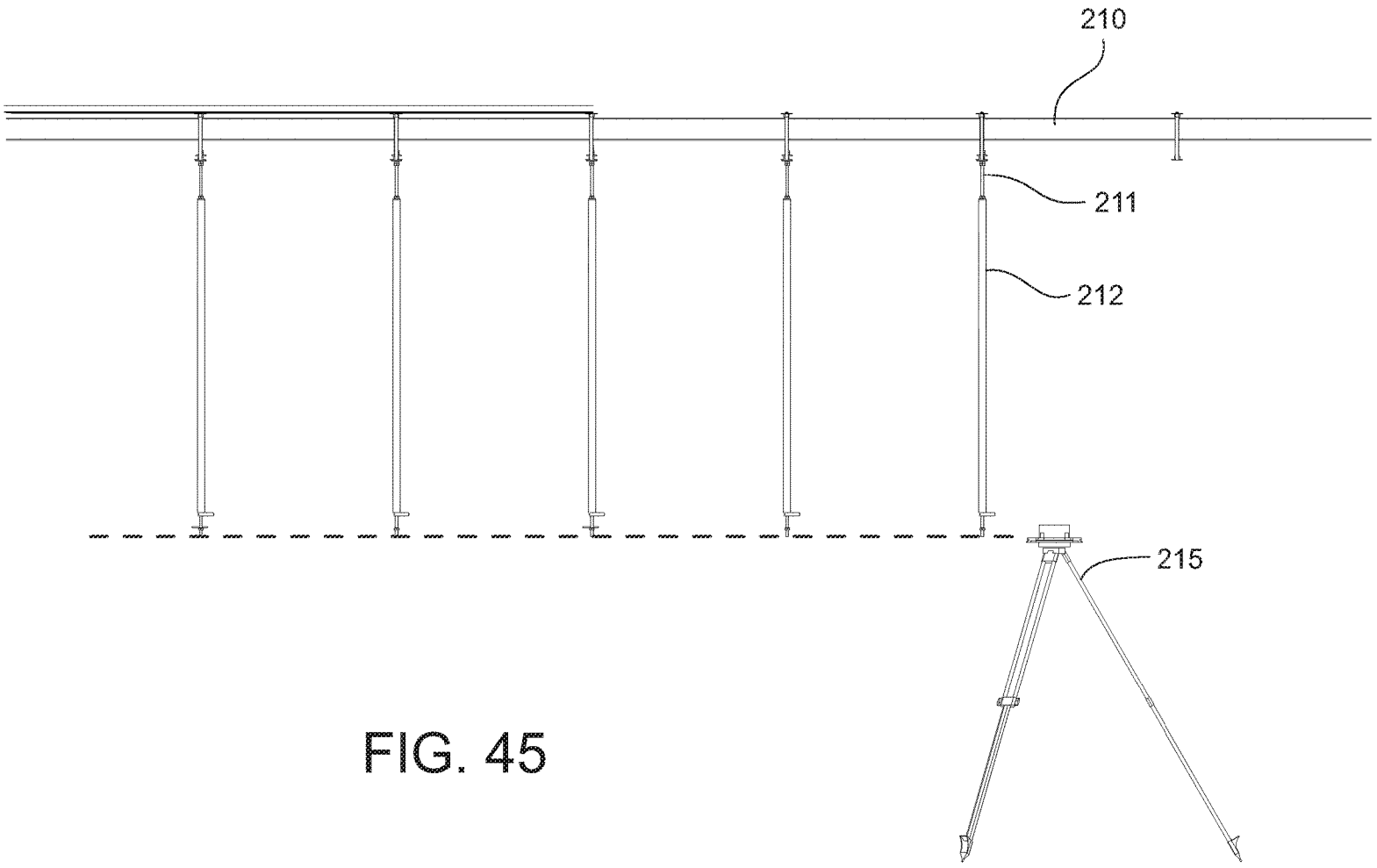
Figure 46:
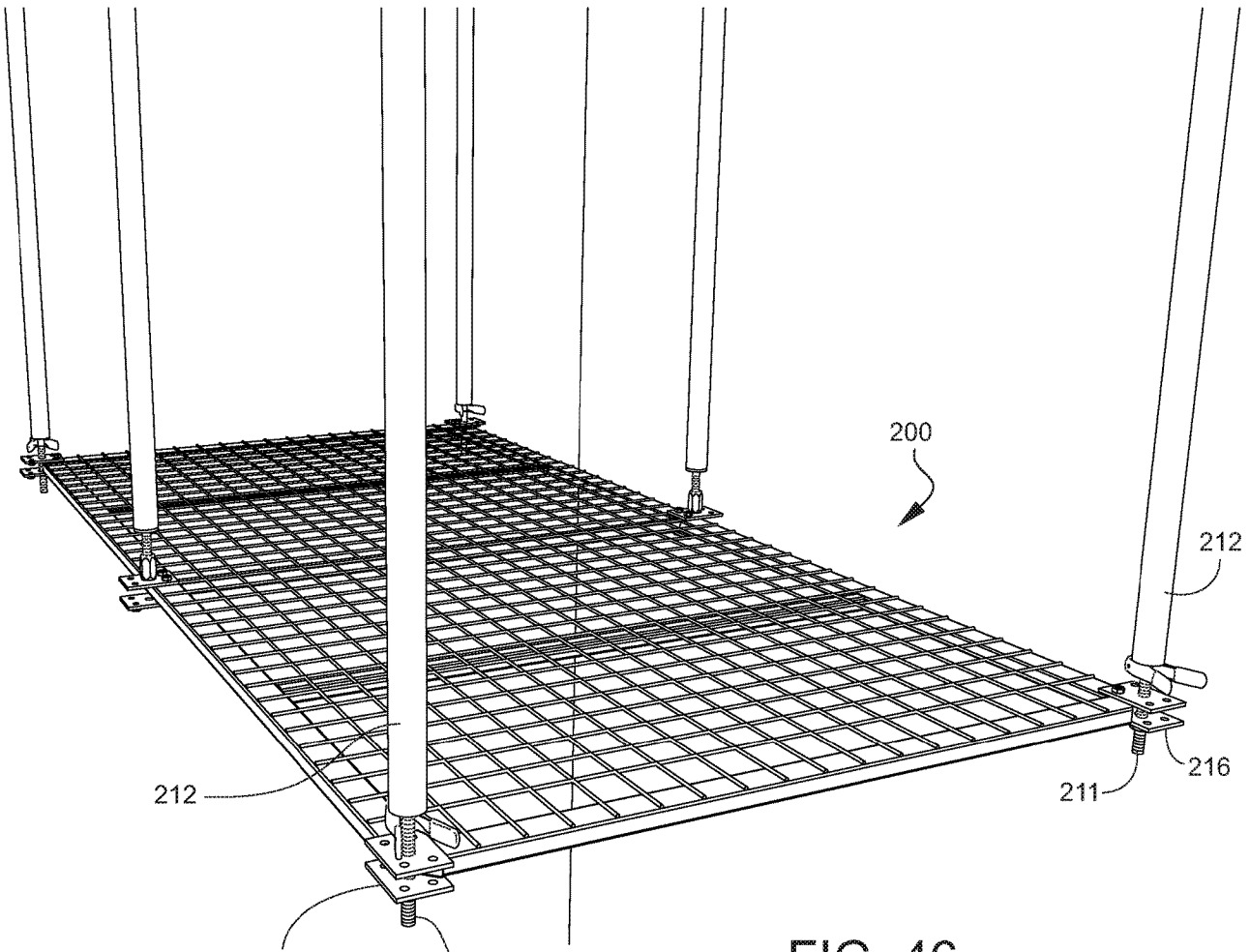
Figure 47:
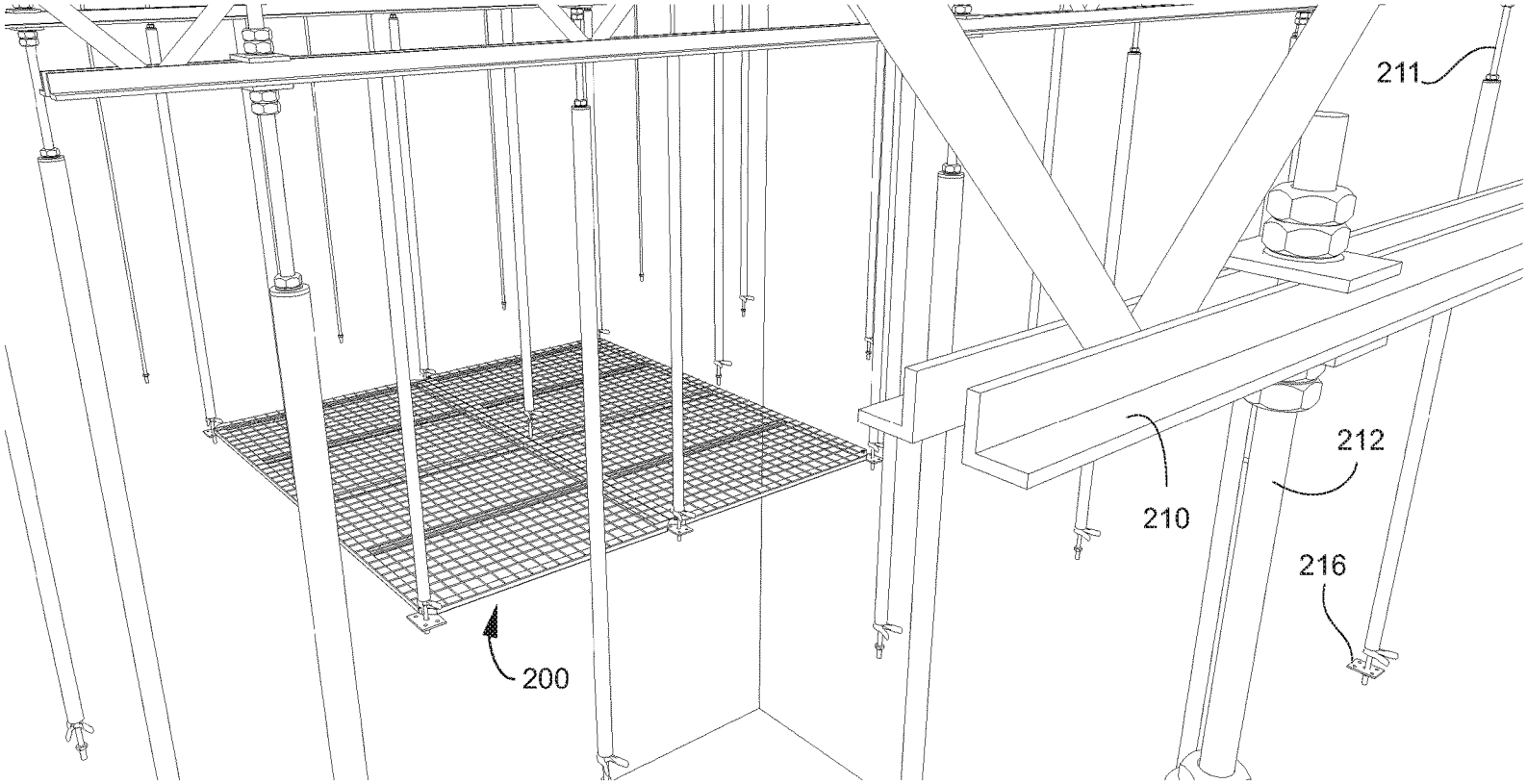
Figure 48:
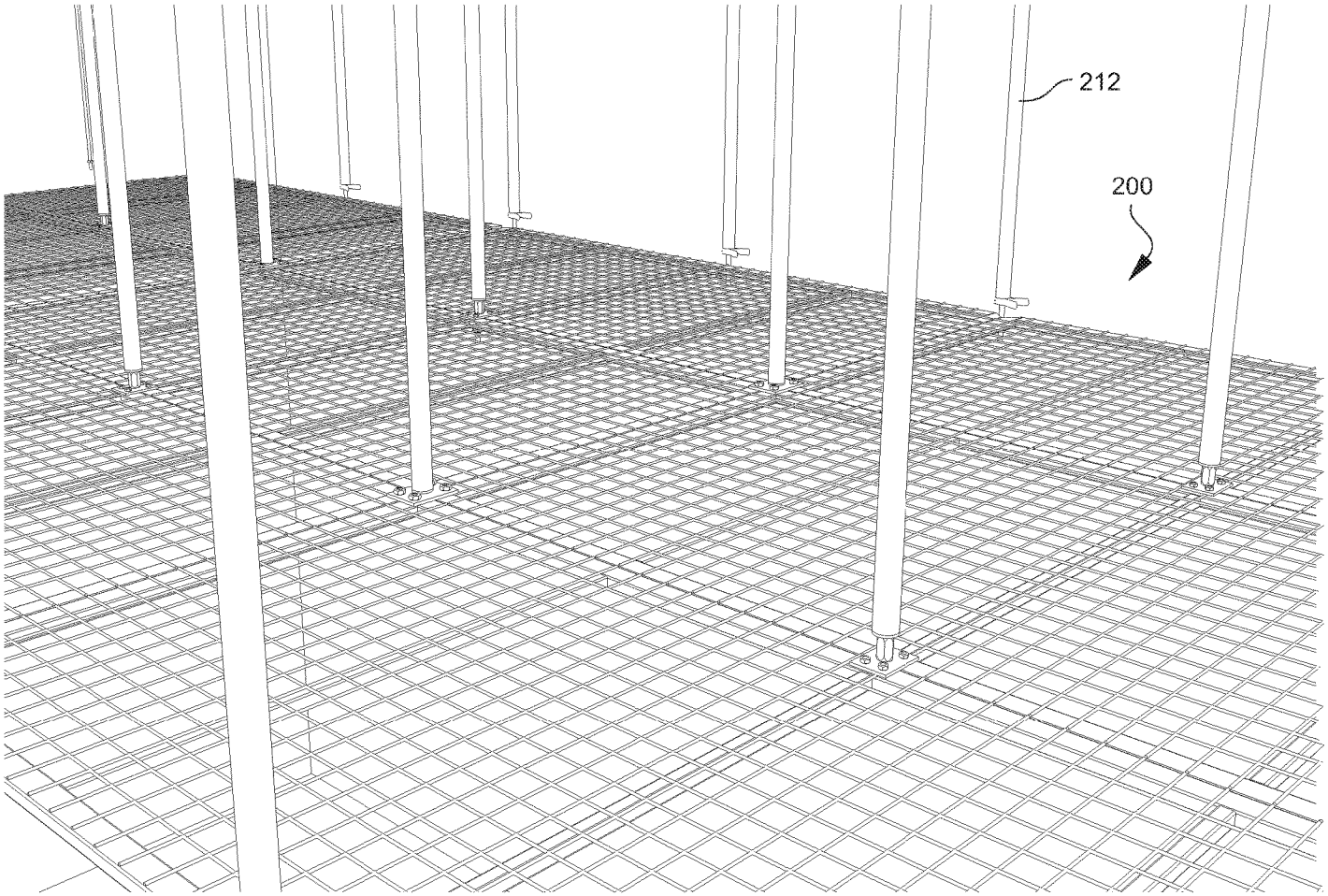
Figure 49:
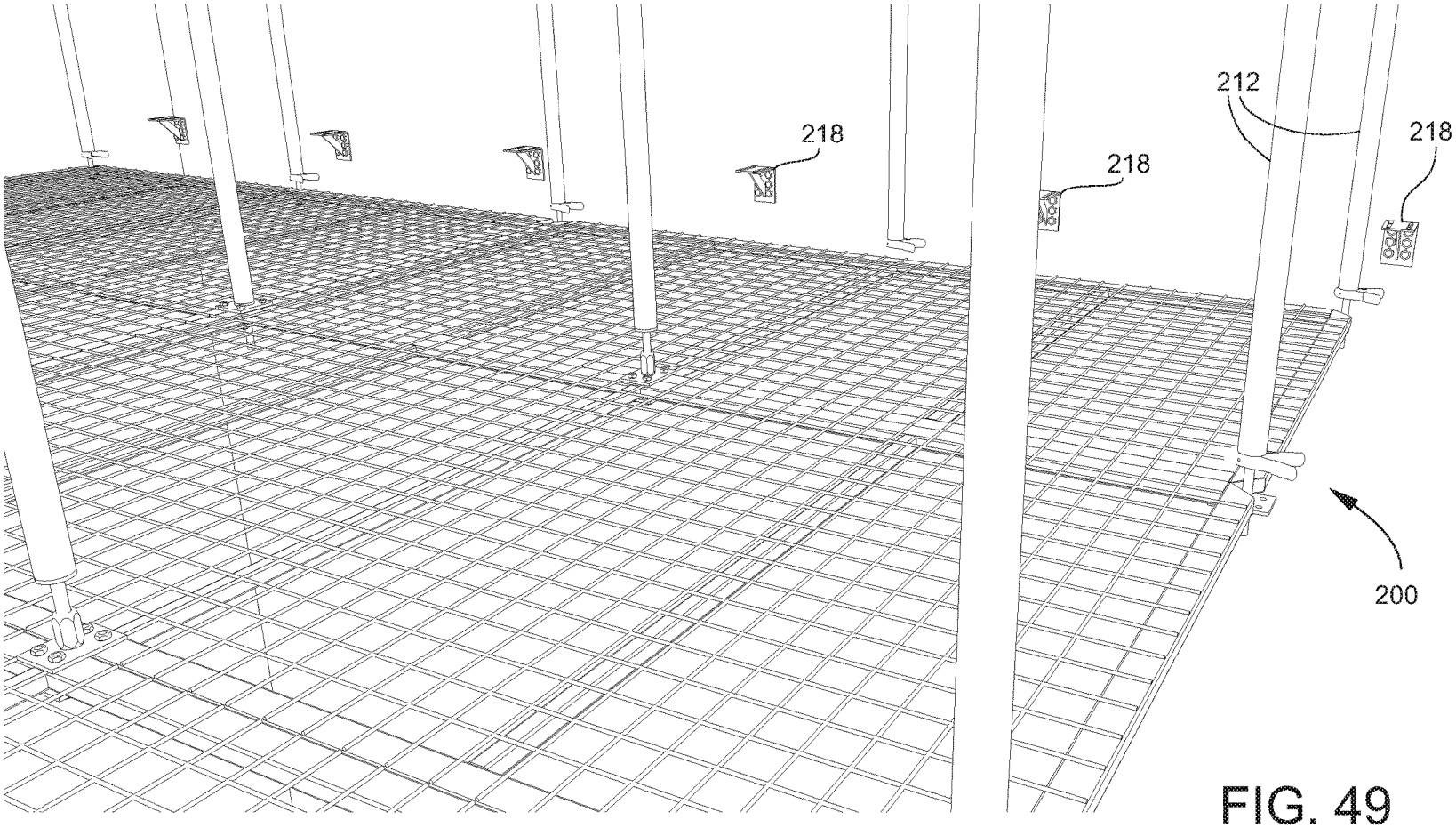
Figure 50:
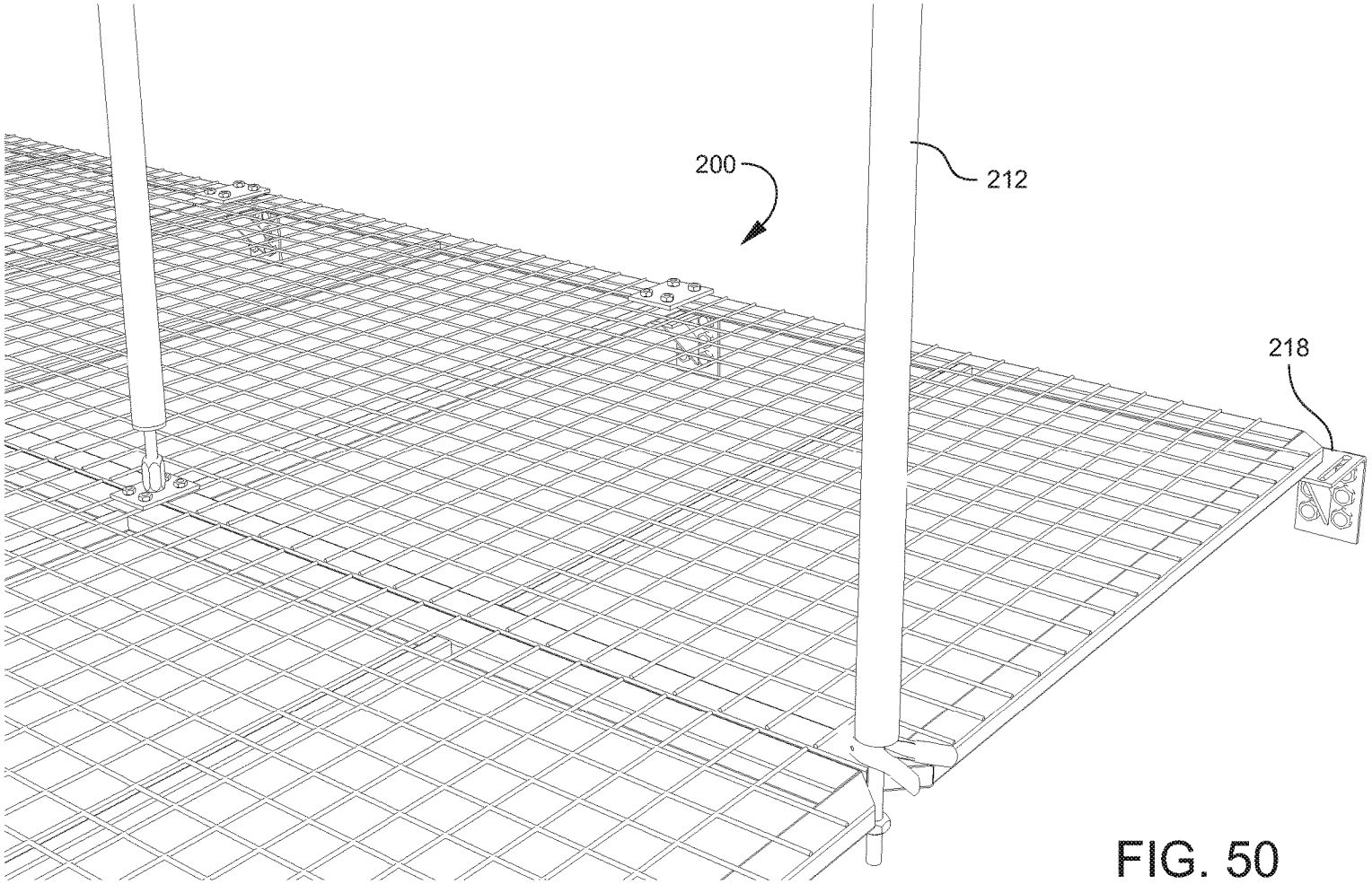

In a further alternative embodiment shown in FIGS. 37 and 38, the exemplary floor structure 50 may be carried on a vertical frame assembly 110. In its most elevated position, the pit lift 100 may be loaded with equipment, instruments, seating, props, and other materials, and then lowered to the protected orchestra position shown in FIG. 38 for unloading. In the lowered position, stage performers are protected from falling while the musicians in the pit are safe from being fallen upon.

The exemplary orchestra pit may be designed as a hydraulic lift, jackscrew lift, locking chain lift, rack and pinion lift, scissors lift or other system that can be raised and lowered as needed. The lift can be lowered all the way to a storage space under the stage, or halfway to floor level, or all the way up level with the stage. The pit can be raised so it is level with the floor of the audience seats to accommodate more seating area. When the pit is fully elevated, level with the stage, it can be used as part of the stage to give more room for larger shows.

Lighting Grid Panel Assembly and Installation

In another exemplary application of the present disclosure, a plurality of lighting grid panels 200 similar to the wire mesh subfloor 11 described above may be assembled together and installed as illustrated in FIGS. 39-50. The lighting grid panels 200 are particularly applicable for use in black box theaters for overhead installation of (and access to) lighting instruments and other above-stage technical equipment. Each exemplary lighting grid panel 200 may feature a solid wire (mesh) woven cloth and a lightweight metal tube frame. The entire panel 200 may be powder coated to any desired color, may be suspended from individual wires or groups of wires, and may be used in combination with spreader bars or other structure designed to distribute the load and increase load capacity. The present assembly enables ready installation of access hatches, and all openings in the assembly may be designed to meet OSHA standards for flooring. If hatches are installed, a mechanism may be provided that prevents the opening of the hatches unless safety guardrails are in place. A further mechanism may also prevent removal of the guardrails without the use of a key or other means.

FIGS. 39-50 demonstrate sequential installation of an overhead flooring system incorporating an interconnected assembly of exemplary lighting grid panels 200. In one implementation, the steps are outlined as follows:

A. Install Suspension Rods:

1. Determine layout and confirm overhead structure 210.
2. Attach threaded rods 211 to overhead structure per structural design.
3. Thread lighting support pipes 212 onto rods 211 to a height approximately 6" above top surface level of grid panels 210—support with single nut at intersection rods and suspension plate at intermediate rods.
4. Set-up rotary laser level 215 (FIG. 45) and set height of the bottom of the panels 210.
5. Use the laser 215 to set the intersection support plates 216 at the correct height.

B. Once rods 211, support pipes 212 and support plates 216 are installed:

1. Place a panel 200 where it can be supported by 4 intersection plates 216. Install ⅜" bolts between the panel 200 and the plates 216—do not tighten.
2. Place the next panel 200 into position on intersection support plates 216 adjacent to the first panel in either the long or short direction.
3. Install ⅜" bolts between the panel 200 and the plates 216, do not tighten.
4. Then, install ⅜" bolts between the two panels 200, do not tighten. This should align the panels with one another.

C. Continue with all of the intersection supported panels 200 until all are in place and bolts are installed in all vertical and horizontal holes between plates, panels, and adjacent panels.

D. Start the installation of the perimeter panels 200 by bolting a panel to both of the suspension plates and the adjacent panel. Utilize the rotary laser (e.g., laser 215) or a 4' level to level the panel. Support the panel 200 at this level with intermediate support rods, ratchet straps or a scissor lift from below. Bolt on a slotted wall bracket 218 and press firmly against the wall. Use the appropriate hardware to mount the bracket to the wall. Remove temporary support.

E. The next perimeter panel 200 can now be installed by resting it on the support plates 216 as well as the first wall bracket 218. Use a level to ensure the panel is level and then install the next bracket.

F. Continue this process around the room until all panels 200 are installed.

G. Next, install the intermediate supports by screwing down their rods 211 to the top of the panels 200 and bolt them into place.

H. Utilize levels or ratchet straps to align the grid in the room—ensuring all rods 211 are plumb and begin first with the wall brackets 218 and then with all other hardware tightening your way across the grid assembly.

I. Once all suspension plates 216 between panels 200 and wall bracket hardware is tight use the top and bottom jam nuts to tighten the support pipes 212 in position down tight to the grid.

J. If required, now install any toe boards, railings, or transition pieces as required by this installation. Installation of the grid is now complete.

Figure 51:
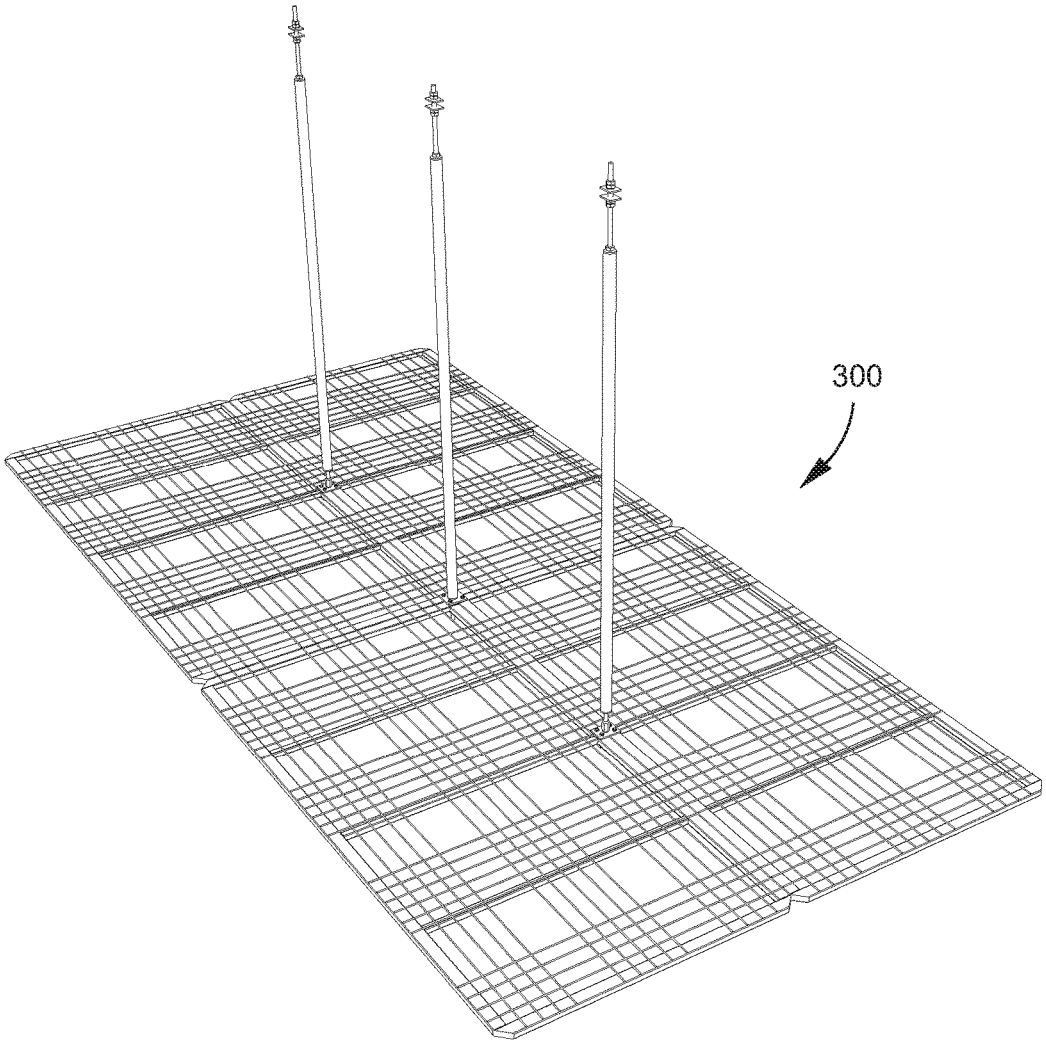
FIG. 51 illustrates an alternative exemplary lighting grid panel.

FIG. 51 illustrates an alternative exemplary embodiment of a lighting grid panel 300 with increased openings in the wire mesh for passing through lighting, equipment, and other items.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A convertible floor panel assembly, comprising:

a metal wire mesh subfloor;

a polymer deck overlying said wire mesh subfloor;

a plurality of alignment heads projecting from an underside of said polymer deck, and designed to extend through respective mesh openings defined by said wire mesh subfloor, and wherein each alignment head is integrally formed with said polymer deck, and defines an internally-threaded fastener hole; and a plurality of panel retainers engaging respective alignment heads, and adapted for removably attaching said wire mesh subfloor and said polymer deck together, such that said floor panel assembly is convertible between a substantially open-surface sound permeable safety structure and a continuous solid-surface structure for increased floor load capacity, and wherein each panel retainer comprises an externally-threaded fastener end adapted for inserting into the threaded fastener hole of said alignment head and a knurled hand knob opposite its externally-threaded fastener end; and a plurality of enlarged-diameter washers each having a fabric backing located on a panel side of said washer, and defining a central opening for receiving the externally-threaded fastener end of said panel retainer and an annular panel-side recess designed for receiving the alignment head of said polymer deck, such that said wire mesh subfloor resides between said washer and said polymer deck.

2. The convertible floor panel assembly according to claim 1, wherein said polymer deck has a thickness ranging from 0.375-1.0 inches.

3. The convertible floor panel assembly according to claim 1, wherein said wire mesh subfloor defines between 36 and 96 uniformly-sized openings per square foot.

4. The convertible floor panel assembly according to claim 1, wherein said wire mesh subfloor and polymer deck have a combined live load capacity of at least about 150 pounds per square foot.

5. The convertible floor panel assembly according to claim 1, wherein said wire mesh subfloor has a live load capacity of at least about 100 pounds per square foot.

* * * * *